US010082028B2

(12) United States Patent
Ambert et al.

(10) Patent No.: US 10,082,028 B2
(45) Date of Patent: Sep. 25, 2018

(54) ROTARY VOLUMETRIC MACHINE WITH THREE PISTONS

(71) Applicants: Jean Pierre Ambert, Ruffey sur Seille (FR); Vincent Genissieux, Grenoble (FR)

(72) Inventors: Jean Pierre Ambert, Ruffey sur Seille (FR); Vincent Genissieux, Grenoble (FR)

( * ) Notice: Subject to any disclaimer, the term of this patent is extended or adjusted under 35 U.S.C. 154(b) by 240 days.

(21) Appl. No.: 14/787,232

(22) PCT Filed: Apr. 25, 2014

(86) PCT No.: PCT/EP2014/058519
§ 371 (c)(1),
(2) Date: Oct. 26, 2015

(87) PCT Pub. No.: WO2014/174103
PCT Pub. Date: Oct. 30, 2014

(65) Prior Publication Data

US 2016/0076373 A1 Mar. 17, 2016

(30) Foreign Application Priority Data

Apr. 25, 2013 (FR) ..... 13 53776

(51) Int. Cl.
*F01C 1/40* (2006.01)
*F01C 21/08* (2006.01)
*F01C 1/44* (2006.01)

(52) U.S. Cl.
CPC ..... *F01C 1/40* (2013.01); *F01C 1/44* (2013.01); *F01C 21/08* (2013.01); *F01C 21/0809* (2013.01); *F04C 2250/20* (2013.01)

(58) Field of Classification Search
CPC ..... F01C 1/40; F01C 1/44; F01C 21/0809; F04C 2250/20
See application file for complete search history.

(56) References Cited

U.S. PATENT DOCUMENTS 3,160,147 A * 12/1964 Hanson ..... F25B 1/04 418/129
3,289,654 A * 12/1966 Geiger ..... F01C 1/44 418/270

(Continued)

FOREIGN PATENT DOCUMENTS

DE 1451741 2/1969
DE 2047732 A1 3/1972

(Continued)

OTHER PUBLICATIONS

International Search Report dated Jun. 18, 2014 in connection with International Patent Application No. PCT/EP2014/058519.

*Primary Examiner* — Mary A Davis

(57) ABSTRACT

The invention concerns a rotary volumetric machine with three pistons comprising an enclosure forming a stator in which there moves a rotating assembly forming a rotor comprising a crankshaft that mechanically engages with the pistons, the rotating assembly defining, inside said enclosure, six chambers of variable volume of which the volume varies when the rotating assembly rotates, each of the pistons delimiting, with the enclosure, a variable volume chamber called the extrados chamber and two consecutive pistons delimiting, with the enclosure and the crankshaft, a variable-volume chamber called the intrados chamber. The geometry of the pistons and of the crankshaft is designed such that each intrados chamber has a capacity greater than or equal to the capacity of the extrados chambers.

20 Claims, 14 Drawing Sheets

(56) References Cited

U.S. PATENT DOCUMENTS

| | | | | | |
|---|---|---|---|---|---|
| 3,295,505 | A | | 1/1967 | Jordan | |
| 3,349,757 | A | | 10/1967 | Artajo | |
| 3,563,680 | A | * | 2/1971 | Jehle | F01C 1/40 418/237 |
| 3,844,685 | A | * | 10/1974 | Eickmann | F01C 21/0863 418/132 |
| 4,144,866 | A | | 3/1979 | Hakner | |
| 8,087,914 | B1 | * | 1/2012 | Soderstrom | F01C 21/08 418/132 |

FOREIGN PATENT DOCUMENTS

| | | | | | |
|---|---|---|---|---|---|
| DE | 2336292 | A1 | * | 2/1975 | F01C 1/44 |
| EP | 1 484 474 | A1 | | 12/2004 | |
| FR | 1404353 | A | | 6/1965 | |
| FR | 1404453 | A | | 7/1965 | |
| FR | 1443953 | A | | 7/1966 | |
| FR | 2936272 | A1 | | 3/2010 | |
| WO | WO 86/00370 | A1 | | 1/1986 | |
| WO | WO 94/16208 | A1 | | 7/1994 | |

* cited by examiner

| Rotation angle | Extrados Chamber A | Intrados Chamber A-C | Extrados Chamber C | Intrados Chamber C-B | Extrados Chamber B | Intrados Chamber B-A |
|---|---|---|---|---|---|---|
| 0° | | | | | | |
| 30° | Explosion Expansion (Motor) | Compression | Intake | Intake | Exhaust | (Motor) |
| 60° | | | Compression | | | Exhaust |
| 90° | | Explosion Expansion (Motor) | | | Intake | |
| 120° | Exhaust | | | Compression | | |
| 150° | | | Explosion Expansion (Motor) | | | Intake |
| 180° | | Exhaust | | | Compression | |
| 210° | Intake | | | Explosion Expansion (Motor) | | |
| 240° | | | Exhaust | | | Compression |
| 270° | | Intake | | | Explosion Expansion (Motor) | |
| 300° | Compression | | | Exhaust | | |
| 330° | | | Intake | | | Explosion Expansion (Motor) |
| 360° | | Compression | | | Exhaust | |

Fig. 30

| Rotation angle | Extrados Chamber A | Intrados Chamber A-C | Extrados Chamber C | Intrados Chamber C-B | Extrados Chamber B | Intrados Chamber B-A |
|---|---|---|---|---|---|---|
| 0° | | | | | | |
| 30° | Intake (Motor) | Exhaust | Intake (Motor) | Intake (Motor) | Exhaust | Intake (Motor) |
| 60° | | | Exhaust | | | Exhaust |
| 90° | | Intake (Motor) | | | Intake (Motor) | |
| 120° | Exhaust | | | Exhaust | | |
| 150° | | | Intake (Motor) | | | Intake (Motor) |
| 180° | | Exhaust | | | Exhaust | |
| 210° | Intake (Motor) | | | Intake (Motor) | | |
| 240° | | | Exhaust | | | Exhaust |
| 270° | | Intake (Motor) | | | Intake (Motor) | |
| 300° | Exhaust | | | Exhaust | | |
| 330° | | | Intake (Motor) | | | Intake (Motor) |
| 360° | | Exhaust | | | Exhaust | |

Fig. 31

ROTARY VOLUMETRIC MACHINE WITH THREE PISTONS

CROSS-REFERENCE TO RELATED APPLICATION(S)

The present application claims priority under 35 U.S.C. § 365 to International Patent Application No. PCT/EP2014/058519 filed Apr. 25, 2014, entitled "ROTARY VOLUMETRIC MACHINE WITH THREE PISTONS", and, through International Patent Application No. PCT/EP2014/058519, to French Patent Application No. 1353776 filed Apr. 25, 2013, each of which are incorporated herein by reference into the present disclosure as if fully set forth herein.

TECHNICAL FIELD

The present invention concerns a three-piston positive displacement rotary machine with an external enclosure forming a stator containing a moving rotor having three pistons, each articulated in its middle on a three-armed crankshaft.

This invention is of particular interest in the fields of combustion engines, turbines, compressors, pumps, hydraulic engines, pneumatic engines, vacuum pumps and steam engines.

BACKGROUND

The principle of rotary machines with three pistons rotating in an enclosure on a crankshaft was first described years ago, for instance in U.S. Pat. No. 3,349,757 (J. I. M. Artajo), patent application WO 94/16208 (B. Tan). These machines are commonly used as engines or pumps.

These three-piston rotary machines were later adapted to work inside the enclosures of rotary machines with a deformable rhombus (RMDR), whose non-circular external shape can contain a deformable rhombus shaped rotor. Furthermore, rotary machines with a deformable rhombus having four chained pistons present geometric particularities that are well known, and reported in patent FR2936272 (V. Génissieux) or patent application WO8600370 (Contiero) in particular.

The possibility of rotating a rotor with three pistons articulated in their middle on a crankshaft with three arms at 120° inside an enclosure with the profile of a RMDR is known and has been described in patents FR 1404353 (J. Lemaître, et al) and U.S. Pat. No. 3,295,505 (A. Jordan) in particular.

However, these state of the art three-piston rotary machines are limited and inefficient. Indeed, only the external variable volume cavities (cavities formed between the pistons and the enclosure) of the machines are functional, i.e. perform a function on the working fluid corresponding to the primary use of the machine, e.g. intake, compression, exhaust for engine mode use, or aspiration, discharge for use in pump mode. The central volume, i.e. formed below the pistons, is not used, or used as a secondary function of the machine, enabling, for example, a cooling function in U.S. Pat. No. 3,295,505 (A. Jordan) or a lubrication function in other applications.

These three-piston rotary machines are therefore relatively inefficient, particularly when compared with four-piston, deformable rhombus machines.

A machine as described in patents DE 1,451,741 and DE 2,047,732 to G. Finsterhoelzl, whose geometry is incompatible with RMDR type enclosure profiles, has three variable volume cavities or chambers below its pistons, but these three chambers are only used for accessory functions, such as lubrication. The displacement of the three chambers below the piston is small compared with that of the external chambers and cannot intrinsically be increased, and certainly not to equal the displacement of the external variable volume cavities.

In this context, the present invention aims to provide a three-piston rotary machine with better power/size and power/mass ratios than the state of the art three-piston machines, with a factor of improvement of around 2 to 2.5, while also offering an economic advantage over machines with four chained pistons, which have a large number of parts and are more complex to produce.

SUMMARY

For this purpose, the present disclosure provides a positive displacement rotary machine with three pistons, comprising an enclosure, forming a stator, inside which a rotary assembly forms a rotor, comprising a crankshaft cooperating mechanically with the pistons. Inside said enclosure, the rotary assembly delimits six chambers of variable volume, whose volume varies during rotation of the rotary assembly, each of the pistons delimiting with the enclosure a chamber of variable volume, called the extrados chamber, and two consecutive pistons delimiting with the enclosure and the crankshaft a variable volume chamber called the intrados chamber. The geometry of the pistons and the crankshaft is adapted so that the displacement of each intrados chamber is equal to or greater than the displacement of the extrados chambers.

The term "equal displacement" herein means an equivalent displacement to within ±20%.

An advantage of a three-piston rotary machine according to the invention is that it uses the internal volume between the pistons to form additional sealed chambers, called intrados chambers, thanks to the geometric complementarity of the pistons and the crankshaft, which defines the variable volume intrados chambers during machine rotation, so that this complementarity is dynamic in that the complementary surfaces of the pistons and crankshaft move away from and towards one another alternately (until they come into contact when the intrados chamber is at its minimum volume or close to its minimum volume) during rotation to create this volume variation of the intrados chamber. Note that the geometries of the surfaces of the piston and of the crankshaft delimiting the intrados chamber, dynamically complementary, are related by a mathematical function to the various geometric parameters of the machine.

The dynamic geometric complementarity and the construction of the specific piston and crankshaft profiles allow the achievement of a three-piston machine according to the invention, whose intrados chambers have the same or greater working displacement as that of the extrados chambers, while the displacement of the intrados chamber of state of the art three-piston rotary machines is more generally between 10% and 20% of the extrados chamber displacement. The invention thus enables functions to be implemented in the intrados chambers that are the same as those implemented in the extrados chambers, i.e. the main functions of the machine when used as an internal combustion thermal engine, hydraulic engine, pneumatic engine, steam engine, pump, compressor, vacuum pump or even a combination of these modes of operation.

The dynamic geometric complementarity of the pistons and crankshaft also allows the production of a machine that is simple and robust to manufacture, using the principle of direct transmission, which can transmit large torques without using a differential system, unlike the known state of the art machines of RNDR type with four linked pistons.

A three-piston rotary machine according to the invention enables the construction of efficient machines, while reducing the number of useful parts, by making them simpler, thus reducing the cost of producing such machines as compared with machines with four linked pistons.

The smaller number of parts, simplified torque transmission from the pistons to the crankshaft (or vice versa) and use of three pistons also enable miniaturization of the machine and therefore competitive power/size and power/mass ratios that are largely superior to those of known state of the art rotary machines with three pistons or four linked pistons.

A machine embodying the invention has six variable volume chambers, each of which can perform the various functions of a cycle characterizing the operation of an internal combustion thermal engine, pneumatic motor, steam engine, hydraulic motor, vacuum pump, compressor, pump, etc.

The internal geometry of a three-piston rotary machine embodying the invention is unusual and quite different from that of machines with four pistons; the pistons have no contact with one another, unlike those of machines with four pistons that form a closed kinematic chain. The state of the art of machines with four pistons cannot therefore be applied directly to a three-piston rotary machine embodying the invention, whose internal geometry is different and which is driven directly by the complementary geometric shapes of the pistons and the crankshaft.

A three-piston rotary machine embodying the invention also offers the advantage of enabling the integration of solutions for performing the additional secondary functions in addition to the main primary functions intrinsic to the operation of the machine, without using the intrados or extrados chambers, which can be used for the primary functions required for the machine's main function. Such solutions may thus include the use of capacitive pistons and a capacitive crankshaft, for example. Such a capacitive element is one that can temporarily store then release some of the fluid in transit in the intrados and/or extrados chambers via retractable cavities. In an application in which the working fluid is a liquid, this capacity can act as a hydraulic anti-blocking device.

Furthermore, in comparison with a RMDR type machine with four linked pistons forming a closed kinematic chain which also has internal and external variable volume cavities, a three-piston rotary machine embodying the invention enables an intrados chamber displacement up to 70% greater than the displacement of the intrados chamber of a machine with four linked pistons, and a total machine displacement per revolution up to 22% greater than the total displacement of a rotary machine with four linked pistons, assuming the compared machines have enclosures with the same oval internal profile. The power developed by the machine being proportional to its flow rate, an RMDR with three pistons embodying the invention therefore achieves a power density, per unit of volume or mass, up to 22% greater than state of the art machines with four linked pistons.

A three-piston positive displacement rotary machine embodying the invention may also offer a significant improvement in energy efficiency with respect to the known rotary machines mentioned previously, with both three or four pistons, i.e. improve the overall efficiency. This may be achieved via a certain number of solutions, including:

Axial and/or radial dynamic sealing elements that offer a significant reduction in mechanical losses, thereby improving the machine's mechanical efficiency.

Dead Volume Reduction Systems Thus Improving the Volumetric Efficiency of the Machine.

Integration of additional secondary functions, notably enabling increased chamber volume and better management of the physical parameters of the working fluids in the six chambers, and/or internal machine drive to reduce mechanical losses due to transmission and enable complete sealing with the outside of the machine.

Elements configured to improve flows and manage intake and exhaust times so as to reduce pressure losses.

A three-piston rotary positive displacement machine embodying the invention may also present one or more of the features below, considered individually or in any technically feasible combination:

The enclosure profile matches the geometric rules applicable to rotary machines with a deformable rhombus (RMDR). The displacement of each intrados chamber is up to 50% greater than the displacement of the extrados chambers.

Each piston has an intrados surface with a profile complementary to the profile of the external surface of the crankshaft so that each piston fits the shape of the crankshaft during machine rotation at a contact position between the intrados surface of the piston and the complementary surface of the crankshaft when the intrados chamber is at its minimum volume or close to its minimum volume; and these complementary surfaces follow an alternating movement towards and away from each other during rotation of the rotary assembly.

Each piston is articulated to the crankshaft via a pivot link with an axis parallel to the rotation axis of the rotary system; this pivot link including a rocker cylinder attached to the piston and cooperating with a complementary concave recess in the crankshaft, called the rocker recess.

Each piston is articulated to the crankshaft via a pivot link with an axis parallel to the rotation axis of the rotary system; this pivot link including a rocker cylinder attached to the crankshaft and cooperating with a complementary concave recess of the piston, called the rocker recess.

Each piston is articulated to the crankshaft via a pivot link with an axis parallel to the rotation axis of the rotary system, this pivot link including a hinge with rocker cylinders attached alternately to the crankshaft and to the piston, the rocker cylinders cooperating with rocker recesses, and the assembly being held by a pin that passes through the rocker cylinders.

Each piston is articulated to the crankshaft via a pivot link with an axis parallel to the rotation axis of the rotary system, this pivot link including a rocker cylinder independent of the crankshaft and the piston, cooperating with two concave complementary recesses, called the rocker recesses, respectively formed in the piston and the crankshaft.

Each piston is articulated to the crankshaft via a pivot link with an axis parallel to the rotation axis of the rotary system, this pivot link including a flexible element housed in two longitudinal grooves of the crankshaft and the piston, respectively.

The flexible element is formed by a flexible blade or by a set of adjacent flexible blades.

The flexible element is a part made from supple material having a frame configured to improve the fatigue resistance of said flexible element.

The pistons and/or said crankshaft and/or said enclosure include a system for providing secondary functions in addition to the main primary functions of the machine carried out in the variable volume intrados and extrados chambers.

The system comprises retractable volumes configured to modify the volume of the intrados and/or extrados chambers.

The system comprises axial or radial cavities in which pistons slide, pushed by mechanical components, such as calibrated springs, configured to exert a thrust force.

The system comprises axial or radial cavities, closed by a flexible membrane sealing the cavities with respect to the intrados and/or extrados chambers, and thus forming said retractable volumes.

The system comprises electromechanical or magnetic components configured to couple torque between the rotary assembly and a drive shaft outside the enclosure or passing through the center of the machine.

The geometry of the pistons is configured to provide intrados chambers with a dead volume between 0 and 100% of the displacement of said chamber.

The geometry of the pistons is configured to provide intrados chambers with a theoretical compression rate equal to that of the extrados chambers by ±20% or greater thereto; the theoretical compression rate here refers to the ratio between the maximum geometric volume of the chamber and the residual dead volume, which does not take into account the leak flow rate of the chamber.

The geometry of the pistons is configured to provide intrados chambers with a theoretical compression rate up to 290. The crankshaft has slots on its external surface, said slots being configured to improve the flow trajectory and provide adjustment of the intake and exhaust flows in said intrados chambers.

Said enclosure is laterally closed by two flanges with openings to enable the intake and exhaust of fluids to the intrados and/or extrados chambers; said openings can advantageously be in communication exclusively with said intrados chambers.

The pistons, flanges, shaft and crankshaft include sealing elements to ensure a dynamic radial seal between the pistons and the enclosure and a dynamic axial seal between the flanges and the rotary assembly, said sealing elements comprising aerostatic or hydrostatic bearings supplied with a pressurized service fluid; the aerostatic or hydrostatic bearings operate directly between two antagonistic surfaces to be sealed or ensure a pivot link of rotating seals configured to roll over the enclosure during piston rotation so that said dynamic sealing systems significantly reduce mechanical losses and wear.

The aerostatic or hydrostatic bearings are supplied with a pressurized service fluid, transported via a set of channels and grooves arranged inside the pistons, flanges, shaft and crankshaft, so that the size and mass of the machine are not affected by the implementation of these dynamic sealing elements nor by the addition of an external generator for this pressurized service fluid.

The service fluid is advantageously tapped from the machine's operating fluid.

The enclosure is closed at the sides by two end flanges with openings to allow the intake or exhaust of fluids in the intrados and/or extrados chambers; the enclosure also has a third flange which is free to translate axially within the enclosure, forming an inlet pre-chamber or outlet post-chamber for the fluid between the rotary assembly and an end flange.

The flange, free to shift axially and called the free flange, is equipped with sealing elements between the intrados and/or extrados chambers and the pre-chamber formed by the free flange; these sealing elements being applied by the axial mobility of the free flange within the enclosure under the effects of the pressure of the operating fluid, so that there is no mechanical clearance between the antagonistic surfaces of the axial stack including the free flange, the rotary assembly and the opposite end flange, thus ensuring a significant reduction in operating fluid leakage in the intrados and/or extrados chambers, and so that this axial mobility of one of the two closing flanges of the intrados and extrados chambers compensates for the mechanical clearance induced by wear of said antagonistic surfaces of said axial stack.

The mobile assembly comprises a counter-thrust actuator, designed to balance the pressures exerted on either side of said free flange, so that the contact pressure between the antagonistic surfaces of said axial stacking is almost zero, thus significantly reducing the mechanical friction losses between the antagonistic surfaces suffering friction in said axial stack.

The pistons have two side flanks, at least one of which has a radial slot positioned opposite one or more openings in the flanges.

The pistons have two side flanks and one extrados surface opposite the enclosure profile, each piston having an internal channel connecting the extrados surface to at least one of the two flanks opposite one or more openings in the flanges.

The pistons are equipped with sealing elements between said pistons and the enclosure; these sealing elements comprise turning seals configured to roll on the enclosure when the pistons rotate or adjustable seals whose contact pressure on the enclosure can be adjusted according to the level of pressure in the intrados and/or extrados chambers, so that the seals significantly reduce mechanical losses and compensate for mechanical clearance due to wear.

At least one piston has a skirt fixed to one of the side flanks of said piston, said skirt having an upper profile similar to the extrados profile of the piston.

BRIEF DESCRIPTION OF THE DRAWINGS

Other advantages and features will become more clearly apparent from the following description of particular embodiments of the invention provided for exemplary purposes only and represented in the appended drawings, in which:

FIGS. 3-14 show alternatives embodiments of a pivot link of the rotary machine illustrated in FIGS. 1 and 2, in which;

FIGS. 3 and 4 show internal elements of a rotary machine with a first alternative embodiment;

FIGS. 5 and 6 show internal elements of a rotary machine with a second alternative embodiment;

FIGS. 7 and 8 show internal elements of a rotary machine with a third alternative embodiment;

FIGS. 9 and 10 show internal elements of a rotary machine with a fourth alternative embodiment;

FIGS. 11 and 12 show internal elements of a rotary machine with a fifth alternative embodiment;

FIGS. 13 and 14 show internal elements of a rotary machine with a sixth alternative embodiment;

FIG. 30 is a table showing various functions implemented by the machine cavities during one revolution of the machine when used as an internal combustion thermal engine;

FIG. 31 is a table showing various functions implemented by the machine cavities during one revolution of the machine when used as a pneumatic or steam engine;

FIGS. 34-36 show another embodiment of the rotary machine according to the invention in which:

FIG. 34 is a cross-sectional view of a rotary machine according to this embodiment;

FIG. 35 is a perspective view of a crankshaft according to this embodiment;

FIG. 36 is a radial cross-sectional view of the crankshaft illustrated in FIG. 35.

FIGS. 41-44 show another alternative embodiment of a rotary machine according to the invention, in which:

FIG. 41 is a perspective exploded view of a crankshaft according to this other alternative embodiment;

FIG. 42 is a side view of the crankshaft according to this other alternative embodiment;

FIG. 43 is a cross-sectional view of the crankshaft according to this other alternative embodiment, along the line A-A shown in FIG. 42;

FIG. 44 is a perspective view of an alternative for one of the crankshaft parts according to this other alternative embodiment.

FIGS. 47 and 48 show a fourth alternative embodiment of a sealing element for a rotary machine according to the invention in which:

FIG. 47 is a perspective exploded view of the rotary machine in which the stator is not shown;

FIG. 48 is an axial cross-sectional diagram, according to the same perspective as FIG. 47, along a tilted plane passing through the rotation axis of the machine.

FIGS. 49-51 show a fifth alternative embodiment of a sealing element for a rotary machine according to the invention, in which:

FIG. 49 is a perspective exploded view of the rotary machine in which the stator and first flange are not shown;

FIG. 50 is an axial cross-sectional view of the rotary machine;

FIG. 51 is a radial cross-sectional view along the median plane of the pistons.

DETAILED DESCRIPTION

Figure 1:
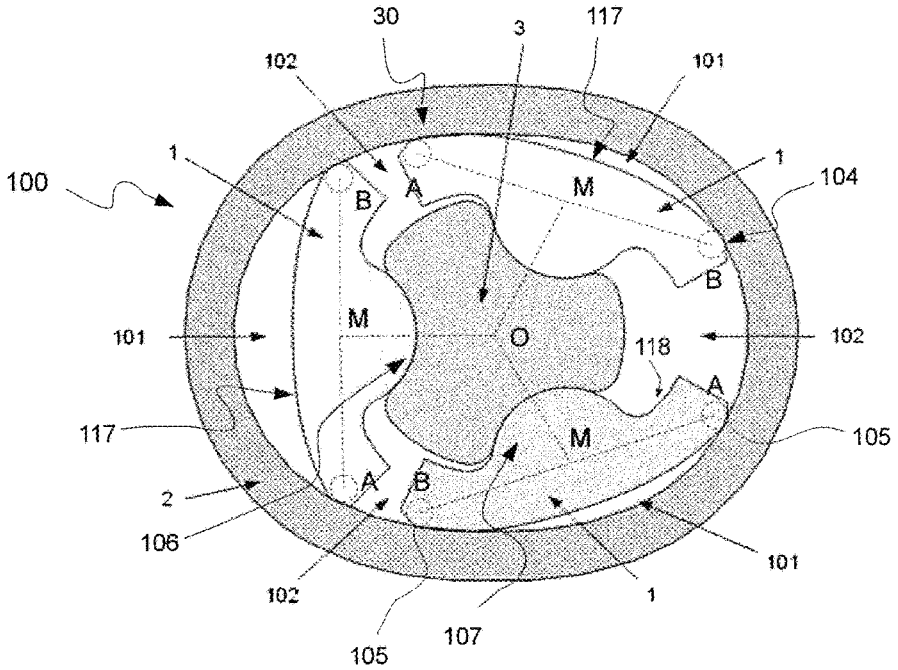
FIG. 1 illustrates internal elements of a first embodiment of a three-piston rotary machine according to the invention.
Figure 2:
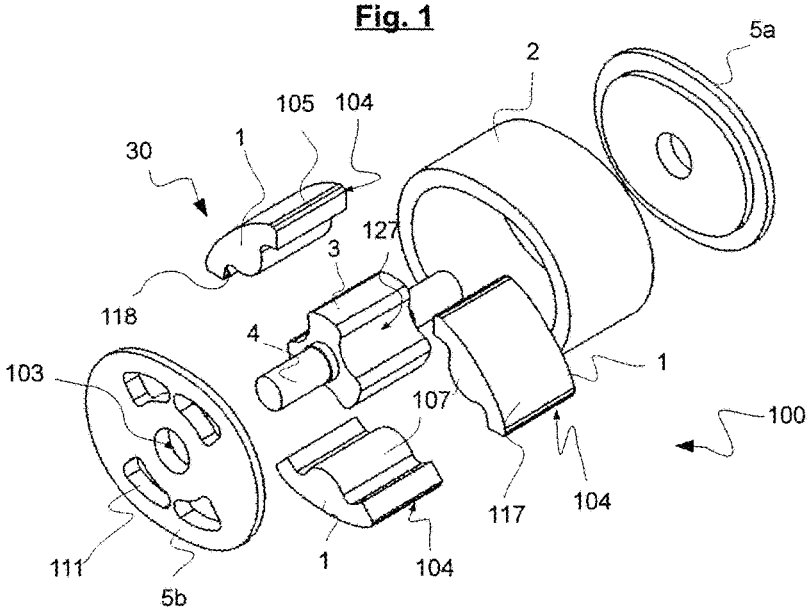
FIG. 2 shows a perspective exploded view of the first embodiment of a three-piston rotary machine according to the invention.
Figure 3:
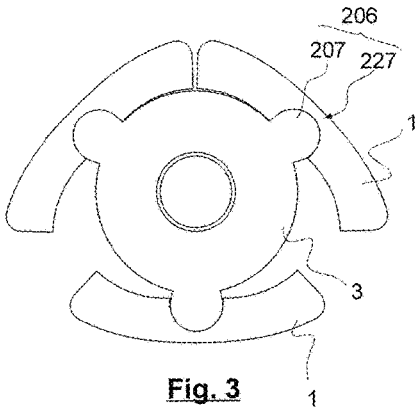
Figure 4:
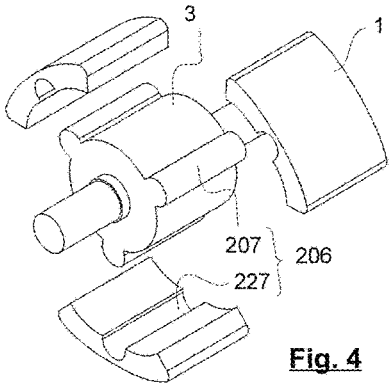

FIG. 1 shows a cross-sectional view of a first embodiment of a three-piston rotary machine according to the invention and FIG. 2 shows an exploded view of the entire machine according to this first embodiment.

The three piston rotary machine 100 comprises a peripheral enclosure 2 forming a stator and receiving a mobile assembly 30 forming a rotor and comprising a central shaft 4 which may or may not be fixed to a crankshaft 3 cooperating with three pistons 1.

The stator 2 has an overall tubular shape of oval section, whose oval profile may comply with the geometric rules applicable to rotary machines with a deformable rhombus (RNDR). These design rules are known and described in state of the art documents, such as patent application FR 2,493,397 by J. P. Ambert. Enclosure 2 is closed at the sides by two flanges 5*a* and 5*b*, which may have openings 111 to allow the circulation of fluids, and bearings 103 in their center to rotationally guide the shaft 4 and/or the crankshaft 3.

The crankshaft 3, which may or may not be fixed to the shaft 4, may either be a solid part or a laminated part whose width (in the axial direction of the machine, i.e. in the direction of the rotation axis of the mobile assembly 30) is approximately equivalent to the width of the enclosure 2. The crankshaft 3 may be in sliding contact with the flanges 5*a* and 5*b* during rotation of the machine 100.

In one embodiment, the crankshaft width may be less than the width of the enclosure 2 so that the crankshaft does not contact the flanges 5*a*, 5*b*.

The width of the pistons 1 may be equal to the width of the enclosure 2, or equal to the width of the crankshaft 3, and they are therefore in sliding contact with the flanges 5*a* and 5*b* on the sides of the enclosure 2. Each piston 1 has an external surface 117 with a cycloid curvature forming the extrados of the piston, and an internal surface 118 forming the intrados of the piston 1.

At the ends of their extrados surfaces 117, pistons 1 have two sliding zones 104, symbolized by an interruption of the cycloid curvature of the extrados surface 117, for example. These sliding zones 104 are intended to be in contact with the internal surface of the enclosure 2 and to promote sealing of the pistons 1 during operation of the machine 100. The sliding zones 104 may be revolution cylinder sectors 105 forming a shape interruption with the cycloid extrados surface 117; the revolution cylinders 105 and the cycloid extrados surface 117 being tangent. The full revolution cylinders 105 are shown in dotted lines in FIG. 1 for illustration purposes. The diameters of the revolution cylinders 105 forming these sliding zones 104 may vary in a range including zero, thus forming sliding zones 104 of variable size, which will be adapted according to requirements, and to the characteristics and architecture of the rotary machine 100.

The pistons 1 and the crankshaft 3 cooperate via a pivot link 106 configured to enable rocking and rotation of the pistons 1 inside the enclosure 2, whose internal profile may advantageously be an RMDR type profile, to enable fitting of the intrados surface with a complementary surface of the crankshaft 3, and to enable transmission of a torque from the pistons 1 to the crankshaft 3 or vice versa.

To turn inside an RMDR type profile, the machine 100 may also have the following geometric characteristics:

The rocking or rotation axis of the pivot link 106 is parallel to the central rotation axis of the transmission shaft 4 and is positioned in the middle M of a segment [AB] defined by the straight line between the centers A and B of the revolution cylinders 105 forming the sliding zones 104 of the pistons 1;

The rocking axis of the pivot link 106 and the rotation axis of the crankshaft 3 are defined at a distance OM, equal to half of the segment [AB].

According to the first embodiment illustrated in FIGS. 1 and 2, the pivot link 106 forms a rocker structure comprising a rocker cylinder 107 (convex male part of the pivot link 106) in the middle of the intrados surface 118 of the pistons 1, cooperating with a rocker recess 127 of the crankshaft 3 having a concave shape complementary to the shape of the rocker cylinder 107 (female part of the pivot link 106). Rocking of the rocker cylinder 107 in the rocker indentation 127 is accompanied by rotation of the pistons 1 in the enclosure 2. The alternating rocking motion of the pistons 1 relative to the crankshaft 3 around the pivot link 106 thus ensures variation of the volume of the intrados chambers 102.

The rocker cylinder 107 may extend over at least part of the width of the crankshaft 3, as shown in FIG. 2. The contact surface between the rocker cylinder 107 and the rocker recess 127 extends over an angular sector large enough to prevent the rocker cylinder 107 from leaving the rocker recess 127, which would result in the piston 1 getting stuck between the enclosure 2 and the crankshaft 3. This sufficiently large angular sector is dependent on the mathematical parameters of the ovoid shape of the enclosure 2, those of the intrados surface 118 and those of the external surface of the crankshaft 3.

To limit the pivoting friction of the pivot link 106, bearings may advantageously be housed in the male parts of the rocker cylinder 107 or in the female parts of the pivot link, such as plain bearings or any other type of rolling bearing able to withstand the alternating rocking movement and wear induced by contact and fretting (wear caused by contact during low amplitude oscillatory movement).

According to a first alternative embodiment of the pivot link illustrated in FIGS. 3-10, the rocker cylinder 207, i.e. the male part of the pivot link 206, is arranged on the crankshaft 3 and the concave rocker recess 227, i.e. the female part of the pivot link 206, is arranged on piston 1. In this alternative embodiment, the female part and the male part have a contact zone that is more than half the section of the rocker cylinder, i.e. greater than 180°. This large contact zone advantageously enables recovery of the centrifugal force of the piston 1 by the crankshaft 3.

Regardless of the alternative embodiment of the pivot link 106, the rocker cylinder 207, i.e. the male part, may be an element added to the crankshaft 3 or to the intrados of the piston 1 in order to simplify the manufacturing process of such a machine and to decrease the parts manufacturing costs.

According to a second alternative embodiment of the pivot link (not illustrated), the rocker cylinder is a part independent from the crankshaft 3 and the pistons 1. In this alternative embodiment, the rocker cylinder cooperates with two concave rocker recesses arranged both in the crankshaft 3 and in each pistons 1.

Transmission of movement between the crankshaft 3 and the pistons 1 is caused by a tangential force transmitted between the female part and the male part of the pivot link 106, 206, the direction of transmission of the tangential force being dependent on the alternative embodiment of the pivot link 106, 206 but also on the direction of transmission of the rotation torque, i.e. from the pistons 1 to the crankshaft 3 or vice versa.

Figure 11:
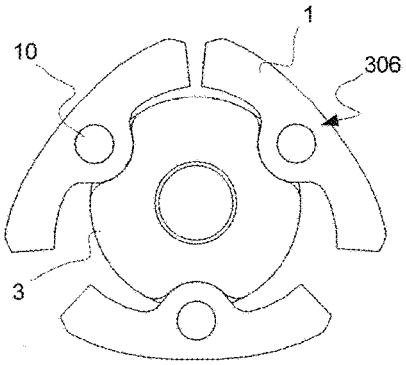
Figure 12:
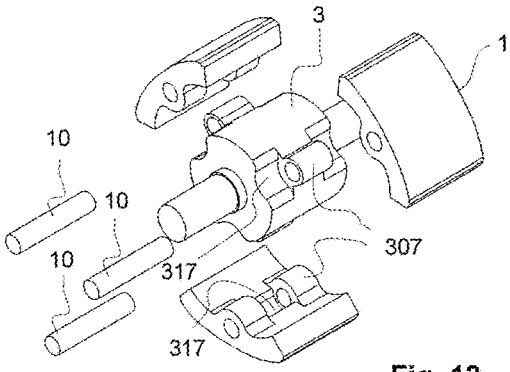

According to a third alternative embodiment of the pivot link illustrated in FIGS. 11 and 12, the pivot link is formed by a hinge connection 306 with rocker cylinders 307 arranged alternately on the crankshaft 3 and on the pistons 1, cooperating with rocker recesses 317, the assembly being supported by a pin 10 passing through the different rocker cylinders 307. In this alternative embodiment, the rocking and the transmission of forces are enabled by the pin 10 of the hinge 306, which is also intended to take up the centrifugal force applied to the pistons 1.

To limit friction and wear due to contact, this pivot link 106 may be made from a material with a low friction coefficient and possibly an additional surface coating. It is also possible to limit friction of the pivot link 106, 206, 306 using suitable bearing components, such as plain bearings, ball bearings or needle roller bearings. It is also possible to limit friction in the contact zone of the pivot link 106, 206, 306 by creating a hydrodynamic or aerodynamic film. This thin hydrodynamic film may be produced by infiltrating some of the compressed fluid flow between the male and female parts of the pivot link 106, 206, 306 so as to favor sliding during rocking.

Figure 13:
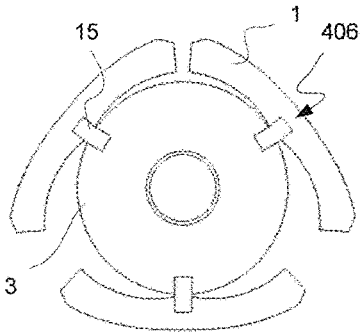
Figure 14:
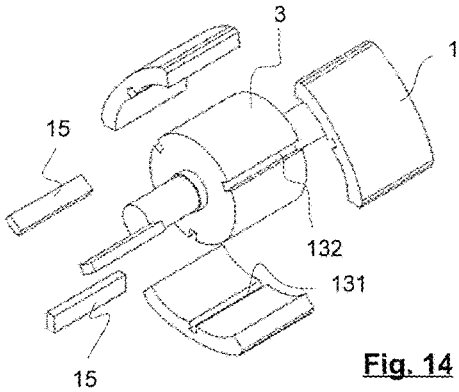

According to a fourth alternative embodiment of the pivot link 406, illustrated in FIGS. 13 and 14, the pivot link 406 is formed by one or more flexible parts with an overall blade shape 15 extending at least over part of the length of the crankshaft 3 and/or the pistons 1. These flexible blades 15 are positioned in two grooves 131, 132 placed in a direction parallel to the rocking axis of the pivot link 406, in each piston 1 and in the crankshaft 3 respectively. The flexible blades 15 may be made by superimposing thin flexible blades or by using a flexible plastic material, such as an elastomer, whose mechanical properties improve resistance to fatigue. The flexible part can also advantageously be reinforced by an armature having a section promoting fatigue resistance of the flexible part, such as an X shape section.

A flexible blade of this kind can, for example, be compressed into the grooves 131, 132, which enables a radial force to be exerted by the elastic return of the blade, thus improving the sealing of the piston/enclosure contacts. A flexible blade of this kind 15 can also improve sealing between each intrados chamber 102 of the machine 100. In this alternative embodiment, the flexible blades 15 therefore perform the pivoting, torque transmission and link sealing functions. The extrados surface 117 of the pistons, with the internal wall of the enclosure 2 and the flanges 5*a* and 5*b*, defines three external chambers 101, called extrados chambers, forming variable volume cavities whose volume varies between a maximal and a minimal volume during the relative movement of the rotor 30 in the stator 2; this minimal volume can ultimately be zero according to the mathematical parameters of the ovoid of the enclosure 2 and those of the extrados surface 117.

The rotary machine 100 also has three chambers 102, called intrados chambers, each intrados chamber 102 being placed between two extrados chambers 101. The intrados chambers 102 are delimited by the intrados surfaces 118 of two consecutive pistons 1, by the side surfaces 115, by the surfaces of the revolution cylinders 105 of the pistons 1 forming a junction surface between the extrados surface 117 and the intrados surface 118 of the pistons 1, by the internal wall of the enclosure 2, by the crankshaft 3 and by the flanges 5*a* and 5*b*. The intrados chambers 102 also form variable volume cavities whose volume varies between a maximal volume and a minimal volume during the relative movement of the rotor 30 and the enclosure 2, this volume variation being advantageously due to the alternating rocking movement of the pistons 1 relative to the crankshaft 3 around the pivot link 106 so that the complementary surfaces of the crankshaft 3 and the piston 1 (formed by the intrados surface 118, the revolution cylinders 105, and the side surfaces 115) move towards and away from each other alternately.

Figure 5:
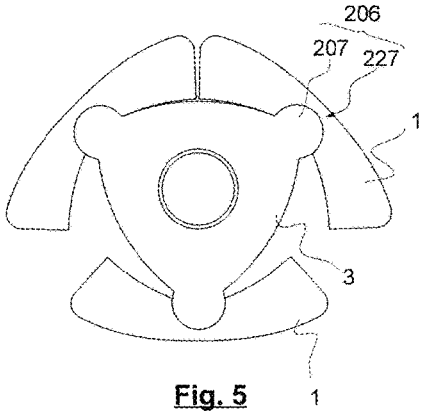
Figure 6:
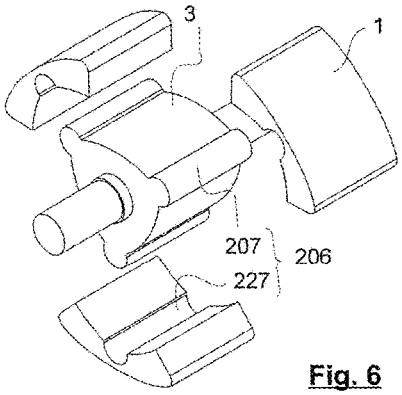
Figure 7:
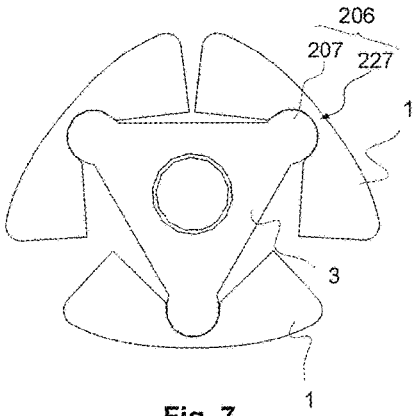
Figure 8:
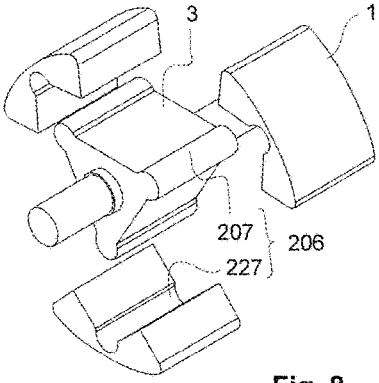
Figure 9:
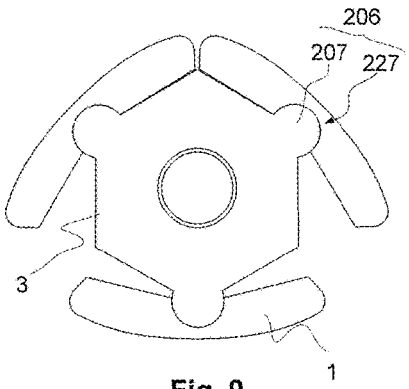
Figure 10:
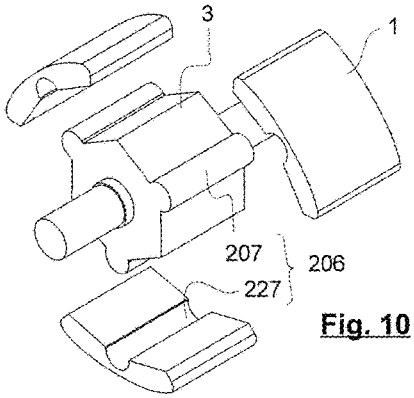

According to the embodiment illustrated in FIGS. 1 and 2, the crankshaft 3 has a circular section. However, according to other alternative embodiments, the crankshaft section can also be triangular, as shown in FIGS. 7 and 8, curvilinear triangular, as shown in FIGS. 5 and 6, or hexagonal, as shown in FIGS. 9 and 10. Regardless of the crankshaft section shape, the associated pistons obviously have an intrados profile complementary to the external surface of the crankshaft. It is understood that the alternative embodiments of the pivot link 106 between the pistons 1 and the crankshaft 3 described previously are applicable regardless of the profile of the crankshaft 3.

Figure 15:
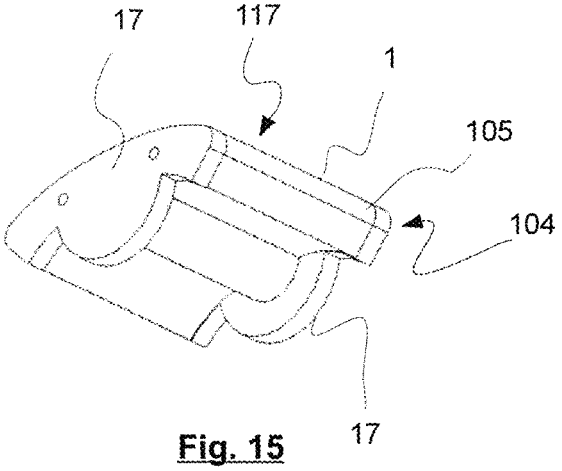
FIG. 15 is a perspective view of an alternative embodiment of a piston of a three-piston rotary machine according to the invention.

According to another alternative embodiment of the invention, the pistons may have skirts 17 fixed to their side flanks, as illustrated in FIG. 15. The skirts 17 are, for example, elements added to the pistons, whose profile adopts that of the extrados surface 117 of the piston 1 for the upper part and is circular or other for the lower part. The profile of the lower part and the thickness of the skirts 17 are defined according to the application and the profile of the piston 1 also to avoid interference with the transmission shaft 4. The skirts 17 flanked on the pistons 1 offer the advantage of making the piston more rigid, particularly when the revolution cylinders 105 forming the sliding zones 104 of the extrados surface 117 have a small radius, or when the radial thickness of the piston 1 is small compared with the pressure exerted by the fluid in the chambers 101, 102. The skirts 17 also enable adjustment of the axial fluid intake and exhaust via the openings 111 in the flanges 5*a* and 5*b*.

Fluid circulation in the enclosure 2, and more precisely in the cavities formed by the intrados 102 and extrados 101 chambers may be achieved via one or more axial openings 111 designed in one or both of the side flanges 5*a*, 5*b* and/or via one or more radial openings (not shown) in the enclosure 2 or in the crankshaft 3. The axial openings 111 may advantageously communicate only with the intrados chambers 102, and the same applies to the radial openings in the crankshaft 3. The rotary machine 100 does not require check valves for intake and exhaust, since the pistons 1, equipped with skirts 17 or not, and/or the crankshaft 3 cover and uncover the axial 111 and radial openings alternately as they rotate. The shape, section, number and positions of the openings enabling fluid entry and exit are defined according to the operating characteristics of the rotary machine 100. The openings are therefore configured according to the application, the fluid and the desired characteristics.

As previously explained, the three-piston rotary machine 100 has six variable volume cavities formed by the three intrados chambers 102 and the three extrados chambers 101. Each intrados chamber 102 is diametrically opposed to an extrados chamber 101 and their volume variations (increase or decrease) are synchronous.

The specific arrangement of the pistons 1 and the crankshaft 3 described previously, and advantageously defined dimensions of the pistons 1 and the crankshaft 3 lead to a three-piston rotary machine 100 with intrados chambers 102 and extrados chambers whose displacements and/or compression rates are equal to the displacements and/or compression rates of the extrados chambers 101 within ±20% or greater thereto. The construction of six variable volume cavities with the same or approximately the same displacement enables the construction of machines operating main primary functions in each of these six chambers, with power/size and power/mass ratios of significant interest to a number of industrial applications and which cannot be provided by conventional machines with three pistons or four linked pistons. For certain applications, it may also be advantageous to have displacements or compression rates in the intrados chambers that are greater than the displacements and/or compression rates of the extrados chambers. The displacement of the intrados chamber 102 can advantageously be up to 50% larger than the displacement of the extrados chamber 101.

Such a machine can thus be used advantageously as an internal combustion thermal engine, hydraulic engine, pneumatic engine, steam engine, pump, vacuum pump or in compressor mode, each of the variable volume cavities corresponding to a specific state depending on the mode of use of the machine.

A three-piston positive displacement machine according to the invention may combine several different modes of use within its six intrados and extrados chambers, simultaneously or successively, and advantageously, up to 4 different modes of use, such as: one compressor mode in the extrados chambers 101 and one expansion engine mode in the intrados chambers 102, or alternatively one hydraulic pump mode in the intrados chambers operating on the right side of the machine and one hydraulic engine mode in the intrados chambers 102 operating on the left side of the machine.

Figure 18:
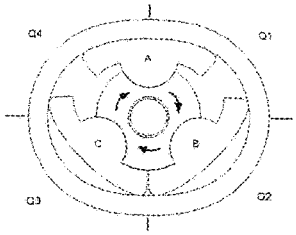
FIGS. 18-29 show the evolution of the internal and external cavities of a three-piston rotary machine according to the invention, represented by simplified cross-sectional diagrams.
Figure 19:
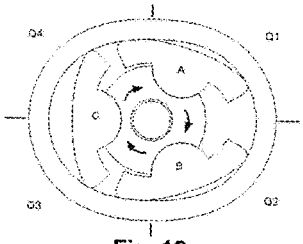
Figure 20:
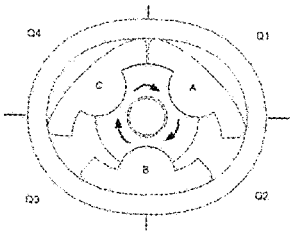
Figure 21:
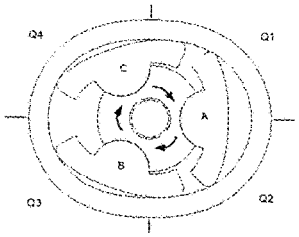
Figure 22:
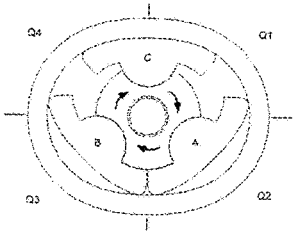
Figure 23:
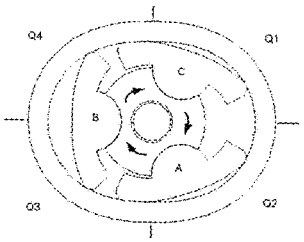
Figure 24:
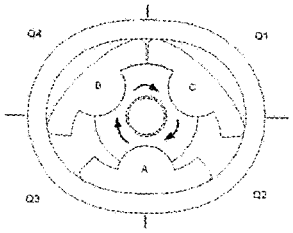
Figure 25:
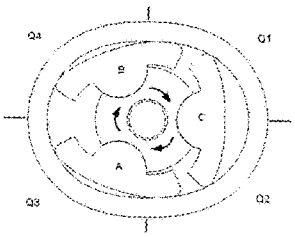
Figure 26:
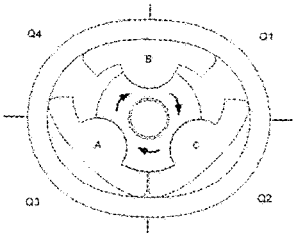
Figure 27:
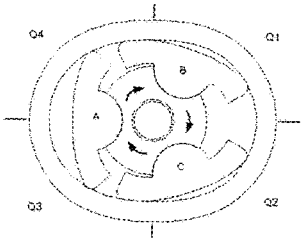
Figure 28:
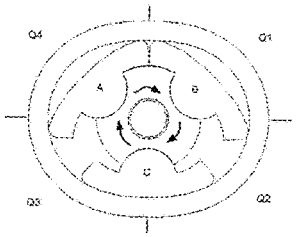
Figure 29:
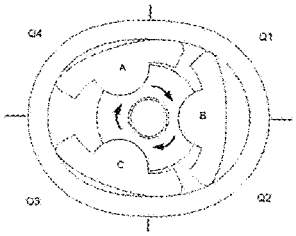

FIGS. 18-29 show different positions of the rotary machine at different angles of rotation of the pistons A, B and C and of the crankshaft with a 30° interval between each figure. FIG. 18 thus shows the position of pistons A, B, C in a reference position, i.e. a 0° angle; FIG. 19 shows the position of pistons A, B, C with a clockwise rotation of 30° from the position of the pistons shown in FIG. 18; FIG. 20 shows the position of pistons A, B, C with a rotation of 60° from the position of pistons A, B, C in FIG. 18 and so on, until FIG. 29, which shows the position of pistons A, B, C with a rotation of 330° from the position of pistons A, B, C shown in FIG. 18. The series of FIGS. 18-29 thus illustrates twelve positions of pistons A, B, C for a full rotation turn of the crankshaft.

FIG. 30 is a table of the different main functions performed by the different variable volume cavities of the machine according to their position in the enclosure during a crankshaft rotation when the machine is used in internal combustion thermal engine mode.

FIG. 31 is also a table of the different main functions performed by the different variable volume cavities of the machine according to their position in the enclosure during a crankshaft rotation when the machine is used in pneumatic engine or steam engine or hydraulic engine mode.

Figure 45:
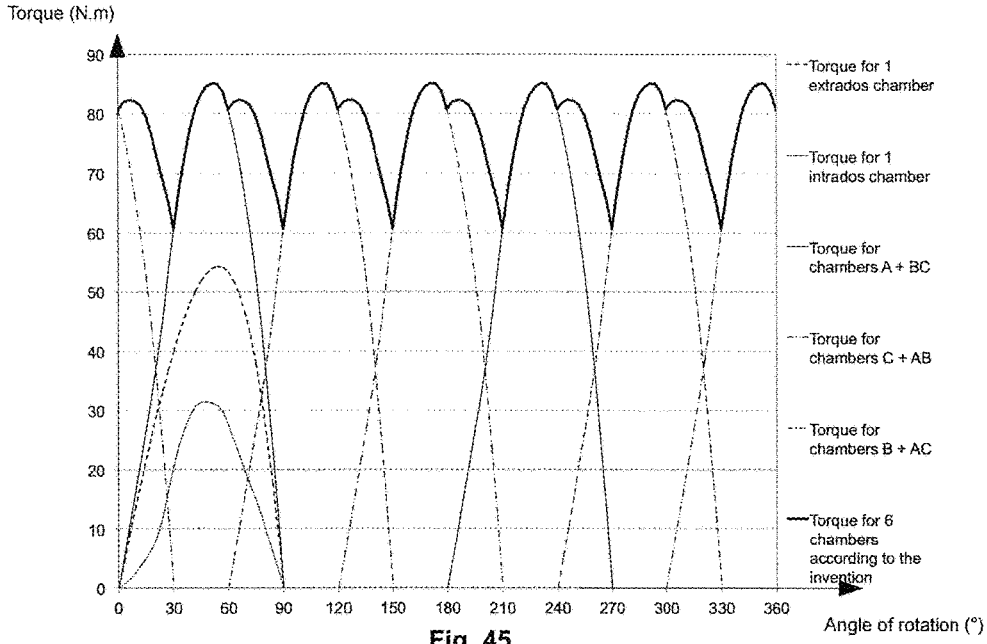
FIGS. 45 and 46 show variations in theoretical gross torque for a rotary machine according to the invention, used as a pneumatic, steam or hydraulic engine, compared with other equivalent machines.

FIG. 45 shows the gross engine torque related to the different main functions of the different cavities illustrated in FIG. 31, when used in pneumatic engine, steam engine or hydraulic engine mode, with a working fluid intake pressure of 10 bars. The theoretical gross engine torque refers to the sum of the torques produced on the shaft by the forces applied to the pistons, excluding mechanical and hydraulic losses. Thus, FIG. 45 illustrates:

The evolution of gross engine torque produced by a single extrados chamber over one quarter rotation turn of the crankshaft (90°);

The evolution of gross engine torque produced by a single intrados chamber over one quarter rotation turn of the crankshaft (90°);

The evolution of gross engine torque produced by one external cavity and the diametrically opposed internal cavity over one quarter rotation turn of the crankshaft (90°), in application of the chamber identification convention used in FIGS. 18-31;

The evolution of gross engine torque produced by all the machine's chambers over one crankshaft rotation turn.

The three piston rotary machine 100 of the invention offers the advantage of having no dead center, i.e. each engine stroke generates a movement that takes one quarter rotation (i.e. 90°) of the machine, each rotor position comprises at least one engine stroke, as shown in FIGS. 30 and 31. Note that (FIG. 31) for operation in pneumatic or steam or hydraulic engine mode, the engine stroke of one intrados chamber 102 is synchronous with the engine stroke of the opposite extrados chamber 101 relative to the rotation axis of the machine.

Figure 32:
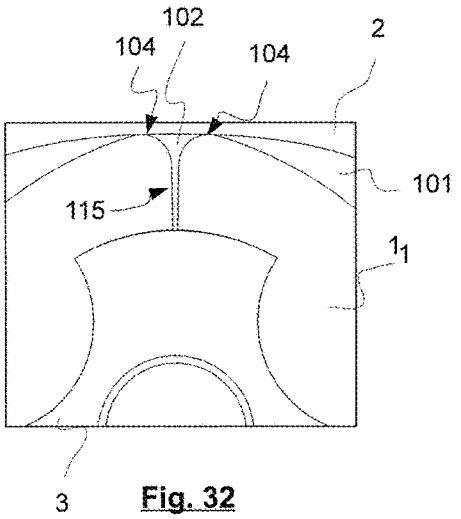
FIGS. 32 and 33 are detailed views of an intrados chamber of the rotary machine according to the invention in two different embodiments, represented by a simplified cross-sectional diagram.
Figure 33:
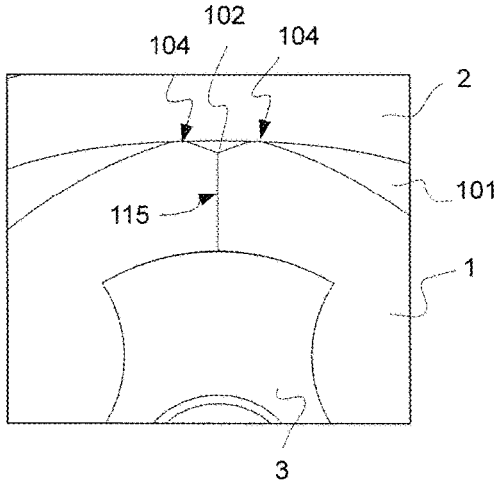

As described previously, the intrados chambers 102 can have a dead volume defined by the volume between two pistons 1, the enclosure 2 and the crankshaft 3 when the pistons 1 are as close as possible, symmetrical relative to a radial plane passing through the rotation axis of the machine. In other words, the dead volume corresponds to the geometric volume of the cavity when it is at its minimum volume at the end of exhaust, this geometric volume can therefore contain a residual volume of working fluid. Due to the specific geometry of the pistons 1 and the crankshaft 3, the dead volume of the intrados chambers 102 is either large, up to 100% of the displacement of the intrados chamber 102, or very small, less than 5%. In certain specific applications, it may be necessary to reduce this dead volume further to optimize efficiency and performance of the rotary machine. In such a situation, the dead volume can be further reduced by altering the geometry of the side surfaces 115 of the pistons 1 and/or by reducing the diameter of the revolution cylinders 105 forming the sliding zones 104. An example of dead volume reduction is shown in FIGS. 32 and 33, by altering the piston geometry, FIG. 32 showing the residual dead volume of an intrados chamber 102 without optimization and FIG. 33 showing the residual dead volume for the same intrados chamber 102 after optimization. Such optimization enables decreasing the dead volume from 4% of the displacement of the intrados chamber 102 to less than 0.5% of the displacement, and advantageously to a theoretical dead volume of 0. A theoretical compression rate may be multiplied by 4, for example, i.e. up to a value of 150 without making any significant change to the displacement of the intrados cavities 102, this displacement after optimization of the dead volume varying by only 0.2%. Depending on the section profiles of the crankshaft 3, this displacement of the intrados chamber 102 can be exactly the same before and after optimization of the dead volume reduction of the intrados chamber 102. Note that the reduction of the dead volume of the intrados chamber 102 involves mathematical functions involving the geometric parameters of the machine 100 according to the invention, concerning in particular the side surfaces 115 and the junction surfaces between these side surfaces 115 and, on one side, the intrados surface 118, and on the other, the extrados surface 117.

In this way, the geometry of the pistons 1 and/or the crankshaft 3 can be modified to obtain theoretical compression rates and/or a displacement that are exactly identical, to a precision of 1/1000, in the extrados 101 and intrados 102 chambers.

Figure 46:
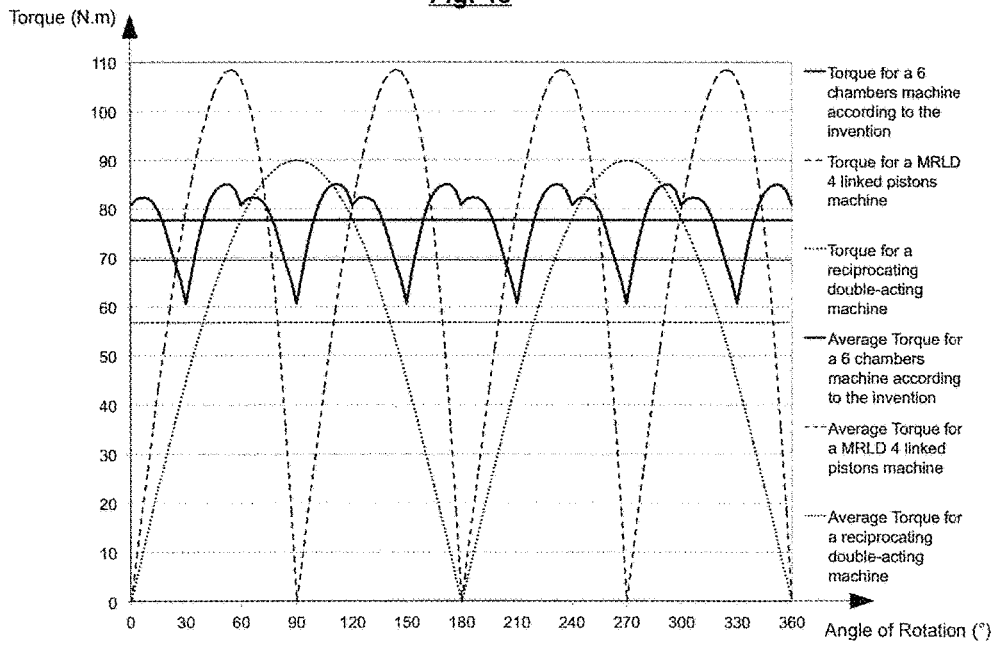

A rotary machine according to the invention thus enables the construction, for example, of a pneumatic engine or a steam engine whose power is greater than or equal to 3,000 Watts at 1,000 rpm, at a relative pressure of 10 bars, in a small overall volume (including a pre-chamber for overheating, located outside the enclosure 2): 14.5 cm length, 11.2 cm wide and 10 cm tall, for a total displacement of 360 cubic centimeters (cm3), and therefore an admitted geometric volume of 720 cubic centimeters per crankshaft revolution. The theoretical gross engine torque (i.e. excluding mechanical and hydraulic losses) of this steam engine according to the invention (illustrated in FIG. 45) varies between 61 and 85 Newton meters (N·m), and its average gross torque over one revolution is 78 N·m. In comparison, a reciprocating double-acting steam engine with a total displacement identical to that of the three-piston machine according to the invention has an average theoretical gross torque of 57 N·m, i.e. 27% less, for a much larger bulk volume and mass. For comparison purposes, FIG. 46 shows the theoretical gross engine torque for one crankshaft revolution, and the average torque of different known state of the art rotary machines (four-piston RMDR, reciprocating double-acting rotary machine). In comparison, an RMDR type rotary machine with extrados chambers, of the same dimensions, of the same external volume and with the same internal ovoid profile of the enclosure, has a theoretical average torque of 69.5 N·m, i.e. 10.9% less than that of a machine according to the invention.

In a second industrial application, a rotary machine according to the invention may be used as a micropump, and advantageously as a dosing micropump if the displacements of the intrados and extrados chambers are the same. Such a dosing micropump could have a total displacement of 0.907 cm3 per revolution (or 907 microliters per revolution) for an external bulk volume of 6.3 cm3. In a micropump application without a dosing function, total displacement may be advantageously increased to more than 1.1 cm3 per revolution, in which case, the displacement of the intrados chamber would be 41% larger than the displacement of the extrados chamber, for the same small dimensions: external diameter 20 mm, axial length 20 mm.

In this application, the theoretical dead volume of the extrados chamber is zero, and that of the intrados chamber is less than 0.35% of the displacement of the intrados chamber, i.e. a theoretical compression rate of the intrados chamber of 290.

Such a micropump, made from suitable steel, has a mass of approximately 50 grams, and enables a pressure difference of more than 20 bars for the version with larger displacement, and more than 100 bars for the dosing micropump version. This micropump can work at rotation speeds of more than 1,000 rpm, and provide hydraulic compression power of around 36 Watt at 1,000 rpm for a differential pressure of 20 bars.

In a third industrial application, a machine according to the invention may serve as a wheel motor in which the crankshaft 3 is rotationally fixed and the enclosure 2, constituting the wheel, rotates. Fluid intake and exhaust in this wheel motor is simple since they are axial via the shaft 4 and the crankshaft 3, which do not rotate in this case, then via the rocker cylinder(s) and recess(es) along specially arranged channels to access the extrados chambers.

An advantage of a three-piston rotary machine according to the invention is that its pistons, crankshaft and enclosure are massive. This specific feature enables the pistons, crankshaft and enclosure to comprise elements offering additional functions, secondary to the so-called primary main functions, corresponding to the operating states of the machine in its various possible modes of use: internal combustion thermal engine, hydraulic motor, pneumatic motor, steam engine, pump, compressor, vacuum pump or a combination of the above modes. Indeed, these additional secondary functions may significantly improve the performance of the machine.

Figure 34:
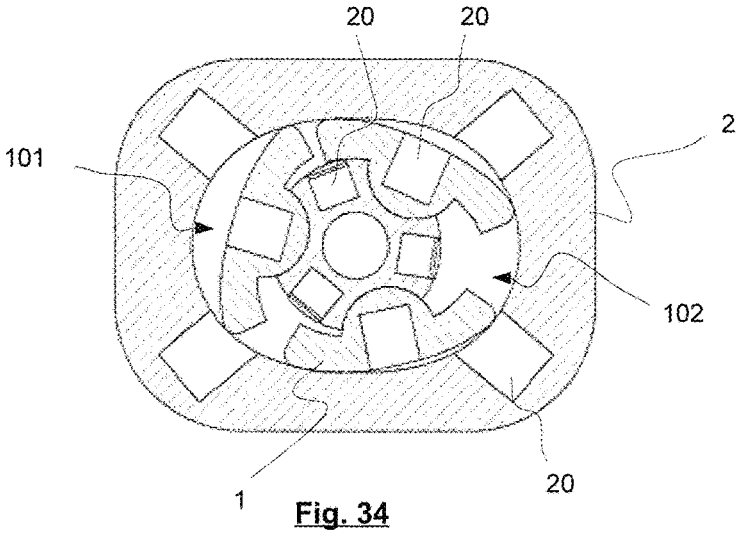
Figure 35:
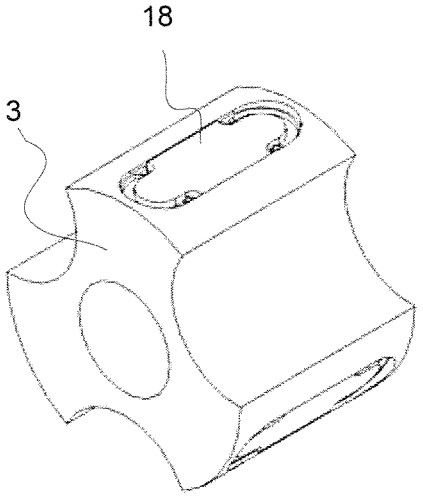
Figure 36:
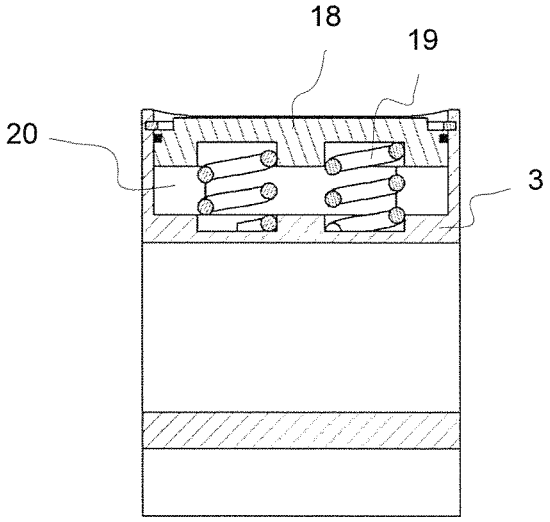

A first example of an additional secondary function may be a hydraulic anti-blocking system to prevent stalling of the mechanism due to the non-compressible property of liquids in a hydraulic application of the machine. This first example is illustrated in FIGS. 34-36. Thus, the pistons 1 and/or the crankshaft 3, and/or the enclosure 2 have retractable volumes 24 that enable an increase in volume and therefore the displacement of the intrados chambers 102 and/or extrados chambers 101. These retractable volumes include axial or radial cavities 20 inside which one or more pistons 18 slide, biased by springs 19, or by any other component able to exert a thrust force, which are sized according to the desired behavior. One example of this anti-blocking system is illustrated on the crankshaft 3 in FIGS. 35 and 36. Of course, this system may also be implemented in the pistons 1, intrados side 118 and/or extrados side 117, and in the enclosure 2.

When pressure in the chamber 101, 102 exerts a force greater than the stiffness of the spring 19, the piston 18 is pushed towards the bottom of the cavity 20, which enables the maximal volume of the chamber to be increased. When pressure falls below the threshold value of the spring 19, the piston 18 moves back, enabling dead volumes of almost zero to be attained. According to this first example or an alternative described below, the use of such a system enables the volume of the extrados chambers to be increased to 200% when applied to the pistons 1, and enables the volume of the intrados chambers to be increased to 70% when applied to the crankshaft 3, relative to the respective initial displacements in a three-piston rotary machine with no such system. Together with the intrados and/or extrados chamber volume increase, this system also enables:

Provision of an anti-blocking function of the mobile assembly 30 at the end of each exhaust cycle where residual liquid may remain in a chamber when the cavity is in its top dead center; thanks to this system the residue is released after the top dead center in the chamber once the chamber moves onto the next cycle;

Delaying the exhaust phase at the end of each intake phase, by suitably positioning the exhaust openings, the system thus enabling liquid to be retained and an overpressure to be created during exhaust.

Figure 41:
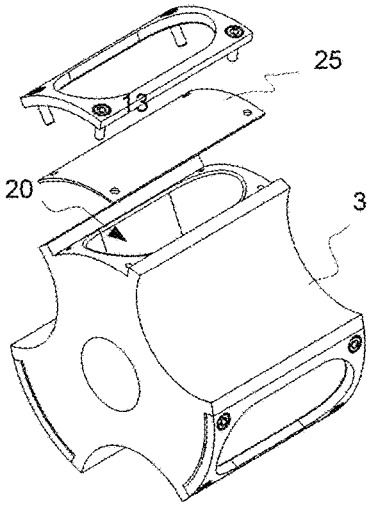
Figure 44:
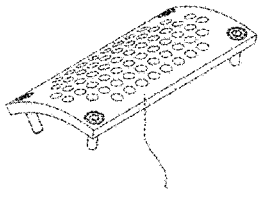
Figure 43:
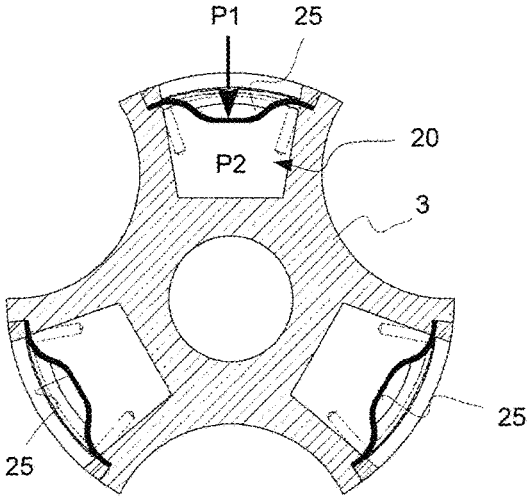
Figure 42:
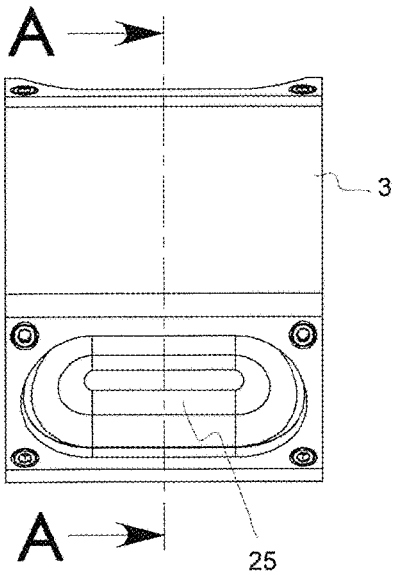

In an alternative of this first example using retractable volume(s) 24, the pistons 18 are replaced by flexible, watertight membranes 25; this alternative is illustrated in FIG. 41 for a cavity 20 housed in the crankshaft 3, showing an exploded view of the assembly with the membrane 25 at rest. Under the effect of overpressure in the intrados chamber 102, this membrane 25 deforms towards the inside of the closed cavity 20 thus ensuring the two functions explained previously: hydraulic anti-blocking at the end of an exhaust cycle and/or retention of the operating liquid at the end of an intake cycle. FIG. 43 is a cross sectional view, along the plane A-A defined in FIG. 42, of the deformation of the flexible watertight membrane 25 when pressure P1 in the intrados chamber 102 is greater than pressure P2 in the closed cavity 20. A plate holding the membrane 25 in place and tight against the crankshaft 3 may advantageously be a grid, as shown in FIG. 44, so that the membrane 25 does not deform inside the chamber 102 when pressure P1 is less than pressure P2, for example if chamber 102 is in an intake cycle and therefore possibly subject to a partial vacuum. A major advantage of this design alternative of the cavities 20 using a membrane 25 is the sealing of the cavities 20. Indeed, if the machine is operating in an external environment under vacuum and/or if its main operating fluid circuit is under a vacuum, and/or if the operating fluid in transit in the intrados and/or extrados chambers is incompressible, these sealed retractable volumes 24 remain fully operational for their function. The fluid in the closed cavity 20 can be a gas or liquid, depending on the function assigned to this retractable volume, identical to or different from the operating fluid in the intrados and/or extrados chambers; its pressure can be regulated by an additional device, internal or external to the machine 100. This system, described here as adapted to the crankshaft 3, can of course be adapted to the pistons 1, intrados side 118 and/or extrados side 117, or to the enclosure 2.

A second example of an additional secondary function may be implemented through electromechanical or magnetic components configured for coupling torque between the rotary assembly 30 and a rotating shaft outside the machine (or vice versa), so that the chambers of the machine can be totally sealed from the environment outside the machine. The electromechanical or magnetic components may advantageously be housed in the crankshaft 3 or in the pistons 1 and cooperate through a sealed, non-magnetic wall with other electromagnetic or magnetic components housed either in or outside the side walls 5*a* and 5*b* of the machine, or in the rotation shaft 4 of the machine passing through the center of the crankshaft 3 and not fixed thereto.

Figure 16:
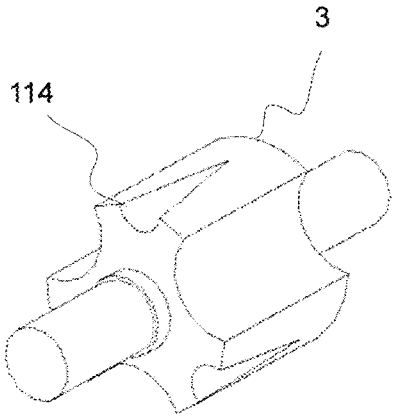
FIG. 16 is a perspective view of an alternative embodiment of a crankshaft of a three-piston rotary machine according to the invention.

A third example of an additional secondary function may be provided for improving the trajectory of the incoming flows (intake flows) and the outgoing flows (exhaust flows) and regulating the flows in the intrados chambers 102. To do so, cylindrical or conical axial slots may be provided in the crankshaft 3. FIG. 16 illustrates an example of a crankshaft 3 with conical axial slots 114, the base of the cone of slot 114 being oriented towards the axial openings 111 of the flanges 5*a*, 5*b*.

Figure 17:
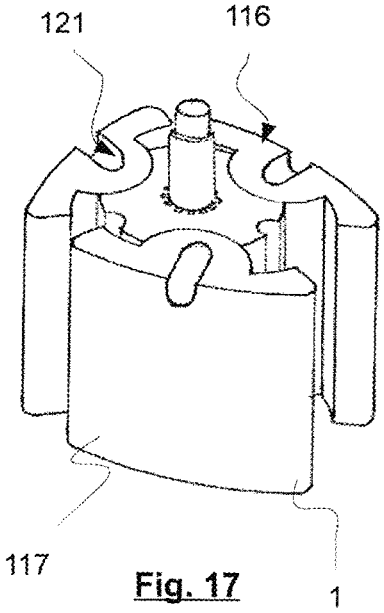
FIG. 17 is a perspective view of an alternative embodiment of a three-piston rotary machine according to the invention.

A fourth example of an additional secondary function may be provided for improving the trajectory of the incoming flows (intake flows) and the outgoing flows (exhaust flows) and regulating the flows in the extrados chambers 101. To do so, slots may be provided in the flanks of the pistons 1. FIG. 17 illustrates an example of the inside configuration of a rotary machine 100 whose pistons 1 have slots 121 on the flanks 116, forming a passage between the flanks 116 and the extrados surface 117. The slots 121 may be replaced by a channel formed in each piston connecting the extrados 117 to one or both of the flanks 116 of the piston 1, thus allowing communication between the axial windows 111 of the flanges 5*a*, 5*b* with the extrados chambers 101 when both face each other.

A rotary machine 100 according to the invention may also have elements for sealing of the intrados (102) and extrados (101) chambers. The rotary machine 100 may therefore include:

A dynamic sealing element between the pistons 1 and the crankshaft 3, and more specifically, between the rocker cylinder 107 and the rocker recess 117;

A dynamic sealing element on the extrados surface 117 of the pistons and advantageously on the sliding zones 104;

Dynamic sealing elements between the flanges 5*a*, 5*b* and parts of the rotary assembly 30, i.e. the pistons 1 and the crankshaft 3.

These sealing systems may be conventional, as commonly used in three-piston rotary machines or in rotary machines with a deformable rhombus (RMDR).

Figure 37:
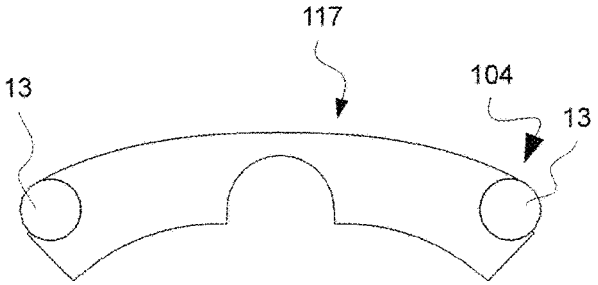
FIG. 37 schematically illustrates a piston with a first alternative embodiment of a sealing element on its extrados surface.

FIG. 37 illustrates a piston with a first alternative embodiment of a sealing element on its extrados surface 117. In this first alternative embodiment, sealing is ensured by a cylindrical seal 13 positioned in a cylindrical groove made in the piston 1. The cylindrical groove in the piston 1 corresponds approximately to the dimensions of the revolution cylinders 105 described previously forming the sliding zone 104 of the piston 1. The cylindrical seal 13 is connected via a pivot link to the piston 1 so as to enable its rotation in the cylindrical groove. The use of material combinations and/or surface treatments with appropriate tribological properties enables reduction of the friction losses of said pivot link of the cylindrical seal 13 in the piston 1, and also ensures adherence of the cylindrical seal 13 against the ovoid surface of the enclosure 2. An improvement of this first alternative embodiment of a sealing element (not shown) comprises mounting the axis of the cylindrical seal 13 on suitably sized bearing components, such as ball bearings, needle bearings or plain bearings, the bearing components being housed in the piston 1 so that they have a controlled radial displacement, thus enabling compensation of the clearance due to wear between the cylindrical seal 13 and the enclosure 2. The cylindrical seal 13 thus rolls over the ovoid surface of the enclosure 2 limiting its wear and mechanical losses. Note that the diameter of the cylindrical seal 13 may be carefully calculated from the mathematical parameters of the machine 100 to ensure that it is entirely contained in the end of the piston 1 and that the bulk thickness between its housing and the side surface 115 is sufficient to guarantee the required level of mechanical resistance. Such an alternative embodiment of a rolling contact seal offers a significant reduction of mechanical losses due to friction between the seal and the enclosure in comparison with other state of the art sealing elements, thus improving the machine's efficiency as well as compensating the clearance due to wear of the seal and thereby extending the life time of this sealing part.

Figure 38:
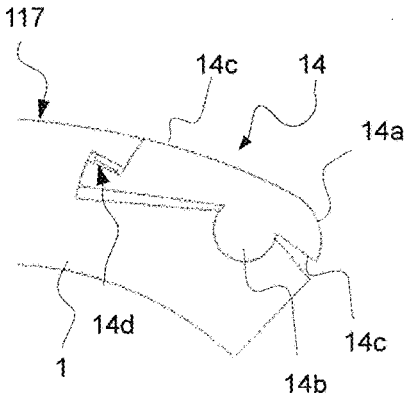
FIGS. 38 and 39 schematically illustrate an end of a piston in a second alternative embodiment of a sealing element in two different positions.
Figure 39:
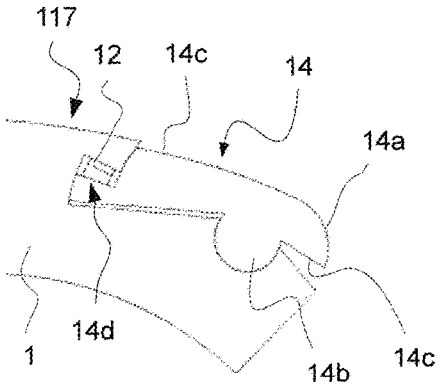

FIGS. 38 and 39 illustrate a piston end comprising a second alternative embodiment of a sealing element. According to this second alternative, sealing is achieved by a tilting seal 14 whose contact pressure against the enclosure (not shown) is provided by the pressurized operating fluid in the intrados and extrados chambers. The profile of the tilting seal 14 may be split in four parts:

A first part 14*a* extending the profile of the revolution cylinder 105 in the sliding zone 104;

A second circular part 14*b*, whose center does not correspond to the center of the revolution cylinder 105 and which forms a pivot link with the piston 1;

A third part 14*c*, which forms pressure surfaces on which the fluid in the intrados or extrados chambers exerts pressure; the pivoting center of the seal 14 being offset from the axis of the sliding cylinder 105, the seal 14 exerts through rotation a contact pressure on the internal ovoid surface of the enclosure 2 at the contact lines.

A fourth part 14*d* is a recess in which a spring element is housed, keeping the tilting seal 14 in its housing and maintaining a minimal contact pressure of the seal 14 against the internal ovoid surface of the enclosure 2.

FIGS. 38 and 39 therefore illustrate two states of the tilting seal 14 of a piston 1 in the rotary machine in two different positions. Such an alternative embodiment also limits friction between the seal and the enclosure 2, thereby improving machine efficiency. This second alternative embodiment also enables:

Creation of contact pressure between the sealing part of the piston 1 and the enclosure 2 that is just enough to ensure sealing, thus limiting losses due to friction and part wear;

Compensation for Clearance Due to Wear.

Figure 40:
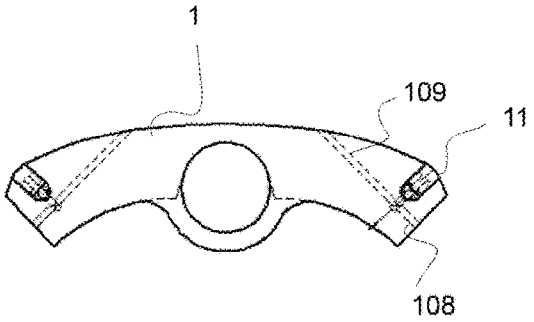
FIG. 40 schematically illustrates a piston with a third alternative embodiment of a sealing element on its extrados surface.

FIG. 40 illustrates a piston with an alternative of the sealing system described above on its extrados surface 117. In this third alternative embodiment, sealing is achieved by a segment 11 pushed against the internal ovoid surface of the enclosure 2 under the pressure of the fluid in the intrados and/or extrados chambers. Segment 11 comprises a bar of rectangular section, one side of which is rounded having a radius substantially equal to that of the revolution cylinder 105 of the sliding zone 104. This rounded surface enables displacement of the piston 1 along the enclosure 2. The segment is housed in an axial groove in piston 1 and is pushed radially by hydraulic or pneumatic pressure towards the enclosure 2. Channels 108 and 109 are made in the piston 1 to connect the axial groove to the intrados chamber 102 and the extrados chamber 101 of the machine respectively and to enable the fluid to enter under the segment 11 to exert radial pressure on the segment 11 that in turn exerts pressure on the internal ovoid surface of the enclosure 2, forming the seal. This third alternative embodiment may also comprise a check-valve system, for example ball-valves that close the channels 108 and 109, enclosing the pressurized fluid in the thrust chamber of the segment 11 at the axial groove. Such a system enables sufficient contact pressure of the segment 11 against the internal surface of the enclosure 2 to achieve the seal. It also ensures compensation for clearance due to wear.

Figure 47:
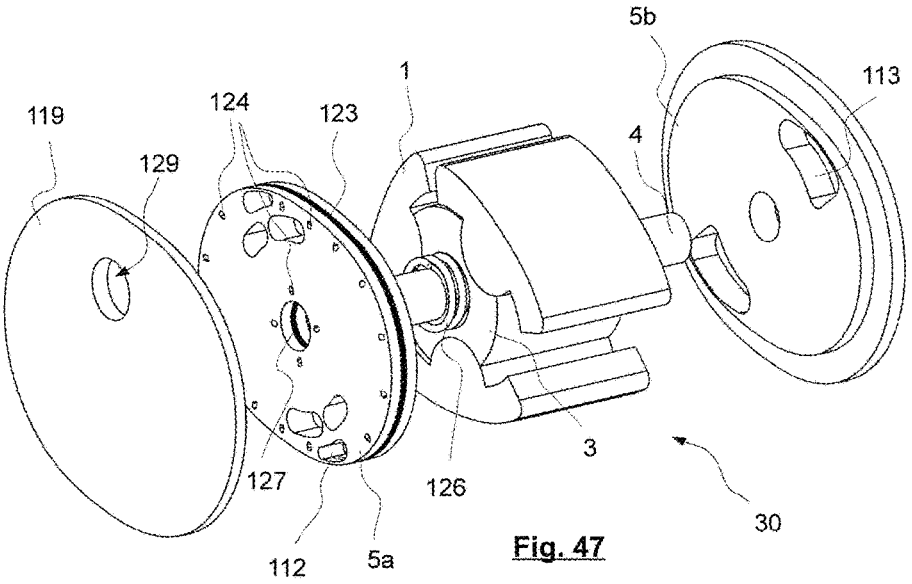
Figure 48:
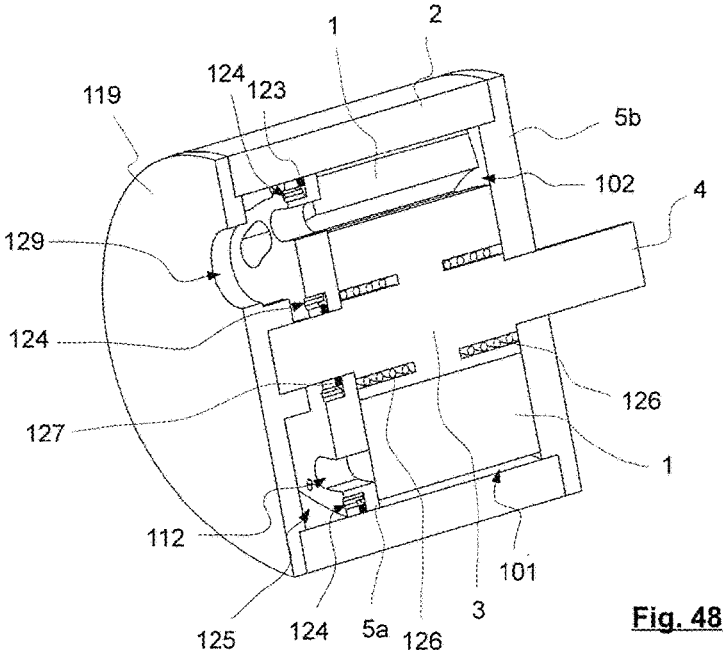

FIGS. 47 and 48 illustrate a fourth alternative embodiment of a dynamic axial sealing element between the two flanges 5*a* and 5*b* and parts of the rotary assembly 30, i.e. the pistons 1 and the crankshaft 3. FIG. 47 is a perspective exploded view of the machine 100 in which the openings 111 for circulation of the operating fluid, illustrated in FIG. 2, are divided into intake windows 112 in the first flange 5*a*, and exhaust windows 113 in the second flange 5*b*.

In this alternative embodiment, the flange 5*b* is fixed to the stator 2 (shown only on FIG. 48). A third flange 119, also fixed to the stator 2, is positioned in front of the intake flange 5*a*, on the opposite side to the chambers, so that one intake pre-chamber 125 is created between the two flanges 119 and 5*a*. The flange 5*a* slides inside the stator 2 in the axial direction of the machine and has a first groove around its periphery, intended to house a peripheral seal 123 and a second groove, inside the cylindrical passage of the shaft 4, intended to house a shaft seal 127. The seals 123,127 ensure sealing between the intrados 102 and extrados 101 chambers and the intake pre-chamber 125.

When the machine 100 is used in hydraulic or pneumatic or steam engine mode, the extrados 101 and intrados 102 chambers achieve an expansion of the operating fluid pressure. Consequently the pressure, P1, corresponding to the operating fluid pressure upstream of the intake windows 112 is greater than or equal to the pressure, P2, of this same operating fluid in the intrados 102 and extrados 101 chambers of the machine, during the expansion phase and then exhaust phase.

The intake pre-chamber 125 thus remains constantly under maximum pressure P1, i.e. the pressure of the operating fluid when it enters the machine via a general intake manifold 129. This constant pressure in the pre-chamber 125 ensures that the intake flange 5*a* is pushed against the rotor 30, and the rotor 30 is pushed against the exhaust flange 5*b*, thus ensuring dynamic sealing by plane-to-plane contact without clearance, and compensation for clearance due to wear between the pistons 1 and the crankshaft 3 on one side, and the flanges 5*a*, 5*b* on the other side.

The intake flange 5*a* also has holes 124, enabling the operating fluid in the pre-chamber 125, under maximal pressure P1, to reach the bottom of the two grooves in flange 5*a*, i.e. the bottom of the peripheral groove and the shaft groove in order to exert thrust on the peripheral seal 123 against the internal ovoid surface of the stator 2 and on the shaft seal 127 against the shaft 4.

To reduce friction and wear of the flanges 5*a* and 5*b* both against the pistons 1 and the crankshaft 3, the sealing means described in this alternative embodiment may be completed with a counter-thrust actuator 126, preferably housed in the crankshaft 3. As shown in FIGS. 47 and 48, this counter-thrust actuator 126 can be embodied by two springs, sized according to the surfaces exposed to pressures P1 and P2 on each side of the flange 5*a* and the characteristics of the expansion cycle in the chambers 101,102, so as to reduce the contact pressure in the axial stack including the flange 5*a*, the pistons 1, the crankshaft 3 and the flange 5*b*.

The counter-thrust force of this actuator 126 may advantageously be variable according to the rotation angle and time so that the force resulting from the counter-thrust of the actuator 126, added to the thrust force against the flange 5*a* by the operating fluid under pressure P2 in the extrados 101 and intrados 102 chambers, is constantly equivalent (and in the opposite direction) to the thrust force against the flange 5*a* by the operating fluid under pressure P1 in the pre-chamber 125. The contact pressures exerted between the flat surfaces of the flanges 5*a*, 5*b* and the parts of the rotor 30 are thus very low or even null.

Finally, this dynamic sealing system may be further refined by providing thin grooves, made either on the surfaces of the flanges 5*a*, 5*b* on the side of the chambers 101, 102, or on the side flanks of the pistons 1 and the crankshaft 3. These fine grooves act as labyrinth seals 156 (not visible on FIGS. 47 and 48). This improvement of the dynamic sealing may also be achieved by texturing the antagonistic surfaces of these parts, with micro-alveoli, inside which a vortex effect is created, resulting in aerodynamic lift between the two antagonistic surfaces moving relative to one another.

This fourth alternative embodiment of a dynamic sealing system is applicable according to the same principle when the machine 100 is used as a compressor, a hydraulic pump or a vacuum pump. Since the pressure P2 of the operating fluid in the chambers 101,102 is less than or equal to the pressure P3 downstream of the exhaust windows 113, the third flange 119 is placed after the flange 5*b* comprising the exhaust windows 113, on the opposite side of said intrados and extrados chambers, forming with the latter a post-chamber of exhaust. In this case, the intake flange 5*a* is fixed to the stator 2 and the flange 5*b* slides axially in the stator 2.

This fourth alternative embodiment of a dynamic sealing system is applicable according to the same principle when the machine 100 has radial openings for operating fluid circulation, i.e. openings made radially in the enclosure 2 and/or in the crankshaft 3, to access the intrados 102 and/or extrados 101 chambers. Thus, the 3 flanges 5*a*, 5*b* and 119 are blind, and the pre-chamber 125 or the post-chamber is filled with pressurized operating fluid upstream or downstream, respectively, of said radial openings.

Figure 49:
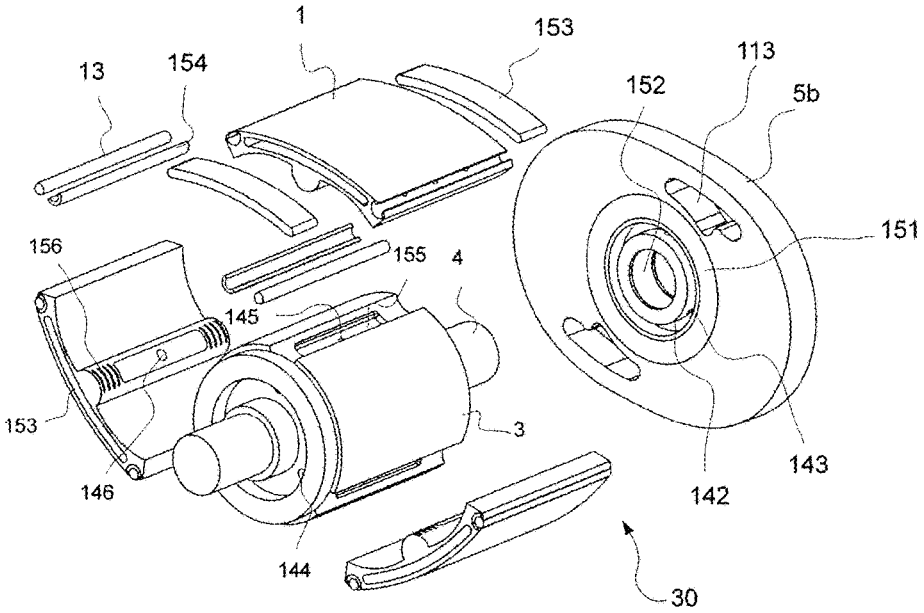
Figure 50:
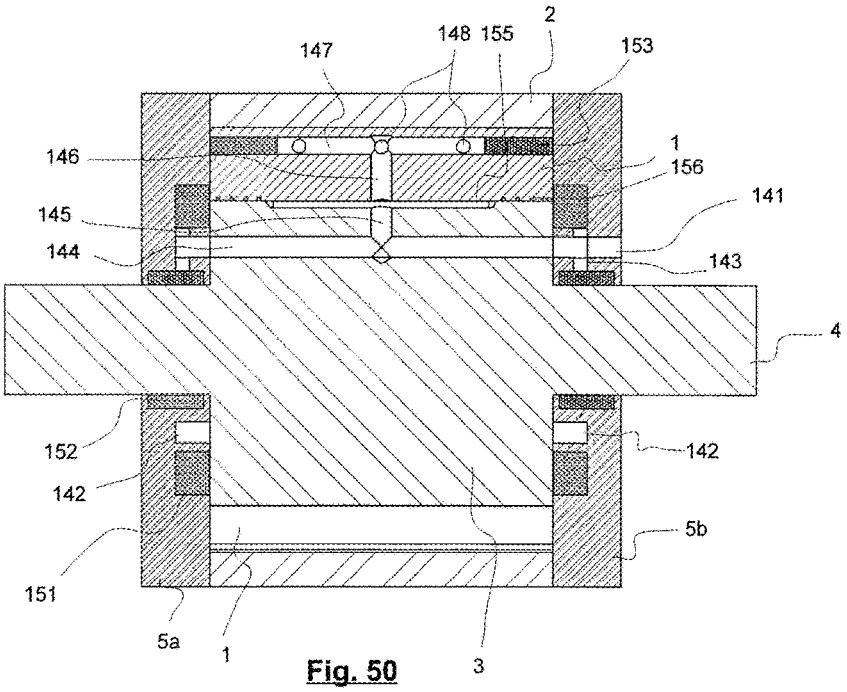
Figure 51:
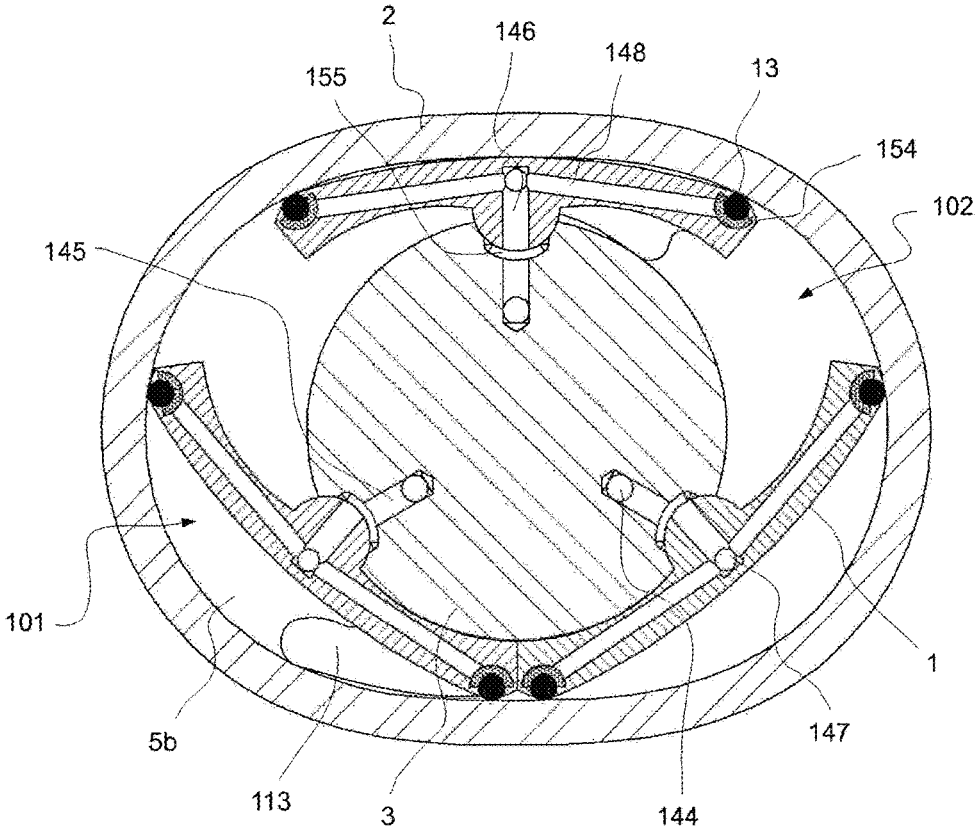

FIGS. 49-51 illustrate a fifth alternative of a dynamic sealing system for the rotary machine. In this fifth alternative embodiment, the sealing system offers axial and radial sealing. Axial sealing is achieved between the two flanges 5*a* and 5*b* and the parts of the rotary assembly 30, i.e. the pistons 1 and the crankshaft 3, and radial sealing is achieved between the piston 1 and the stator 2 via the contact of a cylindrical seal 13 rolling against the internal ovoid surface of the stator 2 during rotation of the rotary assembly 30.

The general principle of this fifth alternative is based on aerostatic bearings, using a pressurized service fluid injected into the flanges 5*a*, 5*b* and inside the parts making up the rotor 30. This service fluid can be either a gas or a liquid under pressure; in the latter case, the bearings are said to be hydrostatic. Ideally, the pressurized service fluid used to supply these aerostatic bearings is the operating fluid of the main function of the machine implemented in the extrados 101 and/or intrados 102 chambers. If the machine 100 is a compressor or pump, some of the pressurized operating fluid flow is tapped from a post-chamber downstream of the exhaust windows 113. If the machine 100 is a pneumatic, steam or hydraulic engine, part of the pressurized operating fluid flow is tapped from a pre-chamber upstream of the intake windows 112. An advantageous variation of this fifth alternative of a dynamic sealing system, not shown in the figures, includes using the service fluid directly from the intrados 102 and/or extrados 101 chambers, by tapping the fluid that operates the main function(s) of the rotary machine 100. In the example shown in FIGS. 49-51 where the machine 100 is a gas compressor, approximately 0.1% of flow rate of gas compressed into, and exhausted from chambers 101, 102 is required to service 20 aerostatic bearings positioned in the various parts of the machine as described below.

FIGS. 50 and 51 are axial and radial cross-sectional views, respectively, of the rotary machine 100 with a dynamic sealing system according to this fifth alternative embodiment. FIGS. 50 and 51 show details of the various channels and grooves conveying the pressurized service fluid from a post-chamber (not shown) located downstream of the exhaust windows 113 to the various aerostatic bearings implemented in the rotor 30 and the flanges 5*a*, 5*b*.

In this alternative embodiment:

The machine shaft 4 is supported by the two bearings 103 which are cylindrical aerostatic shaft bearings 152 housed in each of the flanges 5*a*, 5*b;*

The plan contact of the flanges 5*a*, 5*b* against the crankshaft 3 is supported by two annular aerostatic bearings 151, also housed in each of the flanges 5*a*, 5*b;*

The rocking pivot link 106 of the piston 1 in the crankshaft 3 is an aerostatic bearing pad 155, the pad of pressurized service fluid being either in the rocker cylinder 107 or in the rocker recess 127. The sealing of this aerostatic pad 155 can be completed by radial labyrinth grooves 156 on the rocker cylinder 107 of the piston 1 or on the rocker recess 127 of the crankshaft 3;

The plan contact of each of the two flanks of each piston 1 against the flanges 5*a*, 5*b* is supported by two planar aerostatic bearings 153 housed in each of the two flanks of the piston 1;

The cylindrical seal 13 is supported by a semi-cylindrical aerostatic bearing 154, housed at the end of the piston co-axially to the revolution cylinder 105 described previously and of approximately the same internal diameter than the revolution cylinder. The opening angle of this semi-cylindrical aerostatic bearing 154 enables the cylindrical seal 13, in a pivot link with its semi-cylindrical aerostatic bearing 154, to be in constant rolling contact against the internal ovoid surfaces of the stator 2.

In the variation presented in FIGS. 49-51, these aerostatic bearings are composed of either a pressurized fluid pad in one of the two antagonistic parts of the sliding contact, as illustrated for the pivot link 106, an aerostatic pocket whose opening dimensions are calculated according to the lift pressure required between the antagonistic surfaces, or of porous micro-alveolar materials. The advantage of such materials is that they create a pressure field that is highly regular over the entire diffusion area of the pressurized service fluid and, in the case of the contacts listed above, the formation of a thin film of said service fluid in the mechanical clearance existing between the antagonistic surfaces moving relative to one another. The two antagonistic surfaces then slide on this film of pressurized service fluid. This fluid film confers a lift effect to the antagonistic surfaces, which are no longer touching, and therefore ensures their dynamic sealing with an extremely low friction coefficient, which depends on the viscosity of the service fluid used (around 0.00001 if the service fluid is air). Other mechanical solutions can be implemented for these aerostatic or hydrostatic bearings, as alternatives to the two solutions described above and illustrated in this fifth variation of a dynamic sealing system. Other advantages of using some of the operating fluid as the service fluid to supply the aerostatic bearings include direct availability of the fluid inside the machine 100, thereby eliminating the need to add an external generator, and the non-pollution of the operating fluid in transit in the extrados 101 and intrados 102 chambers by a fluid of a different kind, such as a conventional lubricant. In other words, the operating fluid itself is used as a lubricant.

The pressurized service fluid, tapped from the post-chamber downstream of the exhaust windows 113, passes through the exhaust flange 5*b* via an axial channel 141. It fills the circular groove 142 to enable continuous diffusion in the axial channels 144 of the crankshaft 3 in rotation relative to the flange 5*b*. The service fluid also spreads as far as the shaft aerostatic bearing 152 and the annular aerostatic bearing 151 via the radial channels 143 in the flange 5*b*. From the axial channels 144 of the crankshaft 3, the pressurized service fluid reaches the other flange 5*a* to supply the two other aerostatic bearings 151,152, and the pivot link 106 via the radial channels 145 in the crankshaft 3. The access channels of the pressurized service fluid inside the crankshaft 3 can also be made in the rotation shaft 4 of the machine. Continuing on from the radial channel 145 in the crankshaft 3, the pressurized service fluid fills the aerostatic bearing pad 155 in the rocker recess 127 whose pressure force is exerted against the rocker cylinder 107, supporting it. The width of this aerostatic bearing pad 155 in the radial plane is calculated so that the continuity of service fluid distribution between the radial channel 145 in the crankshaft 3 and the radial channel 146 in the piston 1 is ensured regardless of the position of the piston 1 during rotation of the rotor 30. Finally, from the radial channel 146 in the piston 1, the pressurized service fluid is transported to the planar aerostatic bearings 153 and to the semi-cylindrical aerostatic bearings 154 via the terminal axial channels 147 and the terminal radial channels 148.

In addition to the advantages of the substantial reduction in friction and wear, non-pollution of the operating fluid with a conventional lubricant, the smaller number of parts can also be advantageous in this fifth alternative embodiment. As shown in FIGS. 49-51, the aerostatic bearings, referenced 151, 152, 153, 154, 155, are add-on inserts. However, most of these aerostatic bearings can be grouped on piston 1. Thus, an advantageous alternative lies in manufacturing piston 1 entirely from a solid porous material; this alternative offers the advantage of eliminating all the internal channels referenced 146, 147, 148 required to distribute the service fluid in the piston 1, and all the add-on aerostatic bearings, referenced 153, 154, 155.

A powder sintering process can be particularly suitable for the manufacture of such solid porous pistons 1, followed by a calibration operation to obtain the dimensional and geometrical precision required, then a surface treatment to seal the surfaces of the piston 1 not intended to serve as aerostatic bearings, i.e. those delimiting the extrados 101 and intrados 102 chambers.

In short, a rotary machine according to the invention presents the advantage of having six variable volume cavities of equivalent displacements, or intrados chamber displacements larger than extrados chamber displacements. The displacement equivalence of the different cavities in a three-piston rotary machine is directly and principally (but not only) dependent upon the following interdependent geometric parameters:

Radius of the Rocker Cylinder 107;

Intrados profile 118 of the pistons 1 in correlation with and dynamically complementary to the external profile of the crankshaft 3, these two profiles being mathematically related;

Geometry of the side surfaces 115 enabling modification of the dead volume of the chamber in particular;

Geometry of the junction surfaces between the side surfaces 115 and the intrados surfaces 118 on one side and the extrados surfaces 117 on the other;

Possible use of one or more retractable volumes (24) in the crankshaft 3, and/or in the pistons 1 and/or in the enclosure 2.

Other variations and embodiments of the invention may be envisaged, without departing from the scope of the invention as defined in the claims.

The invention claimed is:

1. A positive displacement rotary machine comprising:

a tubular enclosure having an oval internal section;

a crankshaft rotationally mounted in the enclosure; and three pistons, each piston centrally articulated to the crankshaft inside the enclosure, configured to have two opposite ends in continuous contact with the enclosure as the crankshaft rotates with respect to the enclosure, whereby each piston undergoes alternative rocking about its articulation to the crankshaft;

wherein each piston has two intrados surfaces extending radially on either side of the corresponding articulation to the crankshaft, each intrados surface complementary to an underlying surface of the crankshaft, whereby, as the piston undergoes rocking motion, each intrados surface alternately moves towards and away from the underlying surface of the crankshaft.

2. The rotary machine of claim 1, wherein each of the pistons delimits with the enclosure an extrados chamber of variable volume, and two consecutive pistons delimit with the enclosure and the crankshaft an intrados chamber of variable volume, wherein the pistons and the crankshaft are configured so that the displacement of each intrados chamber is equal to or greater than the displacement of an extrados chamber.

3. The rotary machine of claim 2, wherein the crankshaft has slots in its external surface, the slots configured both to improve a trajectory and to enable adjustment of intake and exhaust flows in the intrados chambers.

4. The rotary machine of claim 1, wherein the crankshaft has a cylindrical shape, whereby the complementary surfaces are cylindrical of same diameter as the crankshaft.

5. The rotary machine of claim 1, wherein the crankshaft has an hexagonal or triangular shape, whereby the complementary surfaces are flat.

6. The rotary machine of claim 1, wherein the internal section of the enclosure is designed based on geometric rules applicable to rotary machines with a deformable rhombus.

7. The rotary machine of claim 1, wherein the articulation of each piston to the crankshaft comprises a flexible element fitted in grooves of the crankshaft and the piston.

8. The rotary machine of claim 1, comprising:

two flanges laterally closing the enclosure; and aerostatic or hydrostatic bearings configured to ensure radial dynamic sealing between the pistons and the enclosure and axial dynamic sealing between the flanges and the crankshaft and piston;

wherein the bearings are configured to be supplied with an operating fluid of the machine.

9. The rotary machine of claim 1, comprising:

two flanges laterally closing the enclosure, including openings for fluid intake and exhaust from variable volume chambers defined by the pistons; and a radial slot in a lateral flank of each piston, positioned opposite one or more of the openings in the flanges.

10. The rotary machine of claim 9, wherein each piston has an extrados surface facing the enclosure, and an internal channel connecting the extrados surface to the slot in the lateral flank.

11. The rotary machine of claim 1, comprising rotating seals at the opposite ends of each piston, configured to roll over the enclosure during rotation of the machine.

12. The rotary machine of claim 1, comprising adjustable seals at the opposite ends of each piston, whose contact pressure on the enclosure is adjusted based on the pressure in variable volume chambers defined by the pistons.

13. The rotary machine of claim 1, wherein at least one piston has a skirt fixed to one of the lateral flanks thereof, conforming to an outer surface of the piston.

14. A positive displacement rotary machine comprising:

a tubular enclosure having an oval internal section;

a crankshaft rotationally mounted in the enclosure; and three pistons, each piston centrally articulated to the crankshaft inside the enclosure, configured to have two opposite ends in continuous contact with the enclosure as the crankshaft rotates with respect to the enclosure, whereby each piston undergoes alternative rocking about its articulation to the crankshaft;

wherein the pistons and the crankshaft have complementary surfaces, configured such that each piston, as it undergoes rocking motion, alternatingly fits an underlying surface of the crankshaft, and each of the pistons delimits with the enclosure an extrados chamber of variable volume, and two consecutive pistons delimit with the enclosure and the crankshaft an intrados chamber of variable volume.

15. The rotary machine of claim 14, wherein the pistons and the crankshaft are configured so that the displacement of each intrados chamber is equal to or greater than the displacement of an extrados chamber.

16. The rotary machine of claim 14, wherein the crankshaft has a cylindrical shape, whereby the complementary surfaces are cylindrical of same diameter as the crankshaft.

17. The rotary machine of claim 14, wherein the crankshaft has an hexagonal or triangular shape, whereby the complementary surfaces are flat.

18. The rotary machine of claim 14, wherein the crankshaft has slots in its external surface, the slots configured both to improve a trajectory and to enable adjustment of intake and exhaust flows in the intrados chambers.

19. A positive displacement rotary machine comprising:

a tubular enclosure having an oval internal section;

a crankshaft rotationally mounted in the enclosure;

three pistons, each piston centrally articulated to the crankshaft inside the enclosure, configured to have two opposite ends in continuous contact with the enclosure as the crankshaft rotates with respect to the enclosure, whereby each piston undergoes alternative rocking about its articulation to the crankshaft;

two flanges laterally closing the enclosure, including openings for fluid intake and exhaust from variable volume chambers defined by the pistons; and a radial slot in a lateral flank of each piston, positioned opposite one or more of the openings in the flanges;

wherein the pistons and the crankshaft have complementary surfaces, configured such that each piston, as it undergoes rocking motion, alternatingly fits the underlying surface of the crankshaft.

20. The rotary machine of claim 19, wherein each piston has an extrados surface facing the enclosure, and an internal channel connecting the extrados surface to the slot in the lateral flank.

* * * * *